US008191482B2

(12) United States Patent
Cylvick

(10) Patent No.: US 8,191,482 B2
(45) **Date of Patent: *Jun. 5, 2012**

(54) LOAD-MINIMIZING, TROLLEY ARRESTER APPARATUS AND METHOD

(75) Inventor: Eric S. Cylvick, Wanship, UT (US)

(73) Assignee: Eric S. Cylvick, Park City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/151,197

(22) Filed: Jun. 1, 2011

(65) Prior Publication Data

US 2011/0303115 A1 Dec. 15, 2011

Related U.S. Application Data

(63) Continuation of application No. 12/233,270, filed on Sep. 18, 2008, now Pat. No. 7,966,940, and a continuation-in-part of application No. 11/605,853, filed on Nov. 28, 2006, now Pat. No. 7,637,213, which is a continuation-in-part of application No. 11/168,101, filed on Jun. 28, 2005, now abandoned.

(51) Int. Cl.
*A63G 1/00* (2006.01)

(52) U.S. Cl. ..... 104/113; 104/249; 104/254; 104/115; 104/117.1

(58) Field of Classification Search ..... 104/113, 104/117.1, 238, 254, 260, 112, 114, 173.1, 104/202, 204, 205, 206, 115, 249, 252, 259, 104/208; 182/3, 11, 191, 10, 234, 235, 71, 182/72; 242/419.4, 147 R, 156; 254/391; 188/65.1, 65.3, 251 A, 65.4; 212/76, 86
See application file for complete search history.

(56) References Cited

U.S. PATENT DOCUMENTS

| | | | | |
|---|---|---|---|---|
| 1,859,180 | A * | 5/1932 | Thiel | 104/113 |
| 3,070,035 | A * | 12/1962 | Russo et al. | 104/113 |
| 6,622,634 | B2 * | 9/2003 | Cylvick | 104/53 |
| 6,666,773 | B1 * | 12/2003 | Richardson | 472/49 |
| 7,381,137 | B2 * | 6/2008 | Steele et al. | 472/45 |

* cited by examiner

*Primary Examiner* — Mark Le
(74) *Attorney, Agent, or Firm* — Pate Baird, PLLC

(57) ABSTRACT

A system comprising a cable held in suspension and a trolley traveling along the cable relies on a brake to control velocity and net downhill acceleration of the trolley. The trolley may include a brake pad positioned to contact the cable. At the downhill end of the ride, the lever actuating the brake is caught and lifted by a capture ring, thus relieving the braking load on the trolley. Also, the trolley engages a comparatively modest, second resistance mechanism, such as, for example, a system of springs, that gradually increases in resistance with distance of motion of the trolley thereagainst, bringing the trolley to a gradual halt.

20 Claims, 23 Drawing Sheets

LOAD-MINIMIZING, TROLLEY ARRESTER APPARATUS AND METHOD

RELATED APPLICATIONS

This application is a continuation of U.S. patent application Ser. No. 12/233,270, filed Sep. 18, 2008, entitled LOAD-MINIMIZING, TROLLEY ARRESTER APPARATUS AND METHOD (now U.S. Pat. No. 7,966,940), and is a continuation-in-part of application Ser. No. 11/605,853, filed Nov. 28, 2006 now U.S. Pat. No. 7,637,213, issued Dec. 29, 2009, entitled UNIVERSAL BRAKE ASSEMBLY, which is a continuation-in-part of U.S. patent application Ser. No. 11/168,101, filed Jun. 28, 2005, now abandoned, and are hereby incorporated by reference.

BACKGROUND

1. The Field of the Invention

This invention relates to suspended cable systems and, more particularly, to novel systems and methods for braking and retrieving trolleys traveling on suspended cable systems.

2. The Background Art

Weather conditions such as temperature and wetness affect the performance of typical trolleys configured to slide or roll along suspended cables. For example, rain on a cable may significantly change the coefficient of fiction between a trolley brake and the cable. Accordingly, a trolley brake that is acceptable for dry conditions, may be unacceptable for wet conditions. Thus, operators must closely monitor weather conditions when using current trolleys. What is needed is a trolley brake providing acceptable performance across a greater range of weather conditions.

Many trolley systems, sometimes called Ziplines, provide no braking. They simply use a cable declining at a shallow angle in which a rise at the lower end slows a user. Others may have a brake set at a fixed parameter. Also, current trolleys do not provide a user control "on-the-fly" over the magnitude of a braking force or friction force generated by the trolley as it travels along a cable. That is, to one degree or another, a user or knowledgeable operator must preselect the braking force or the range of braking force to be provided by the trolley. Once selected, the arrangement is not easily or safely changed without stopping the trolley and relieving the trolley of the user's weight. In certain embodiments, legal liability and user inexperience may favor such inflexibility. However, in other embodiments, greater user control may be desirable. Accordingly, what is needed is a trolley providing safe, "on-the-fly" adjustment between minimum braking and maximum braking.

Furthermore, when using a trolley as the basis for an amusement ride, revenue may largely depend on the number operators employed to operate the ride and throughputs the number of users served within a given period of time. Currently, to a large degree, safety concerns dictate the numbers for both. For example, one of the potential hazards of an amusement ride employing a trolley is the possibility of collision. A first rider may ride a first trolley to some location along a cable. Assuming that the first rider has reached the bottom and exited the ride, a second rider may ride a second trolley down the same cable. Accordingly, if the first rider did not actually reach the lower end due to over-braking, serious injury may occur when the second rider collides with the first rider. What is needed is a trolley retrieval system configured to maximize user throughput, minimize operator interaction, and reduce or eliminate the risk of collision.

BRIEF SUMMARY OF THE INVENTION

In view of the foregoing, in accordance with the invention as embodied and broadly described herein, a method and apparatus are disclosed in one embodiment of the present invention as including a trolley comprising a frame, a brake assembly, and a sheave mount. In selected embodiments, a brake assembly in accordance with the present invention may provide significant adjustability. For example, a brake assembly may include a brake pad that may be removed and replaced, should wear so dictate. Additionally, a brake pad may itself be readily adjustable to provide a desired or customized braking effect to suit conditions.

Various material properties and characteristics may be considered when selecting a material for a brake pad in accordance with the present invention. Often a material that has certain advantageous characteristics may have others that are disadvantageous. For example, one material may have excellent wear resistance, but its coefficient of friction against a cable may vary greatly depending on whether the cable is dry. Accordingly, the material may be suitable for dry conditions, yet be hazardous for wet conditions.

In certain embodiments, it may be advantageous to provide a brake pad having repeatable and consistent performance with respect to wear, coefficient of friction, or the like regardless of temperature, wetness, etc. To provide the advantages of a brake pad in accordance with the present invention, a brake pad may be formed of various segments, typically positioned in series. So positioned, the width of each segment may control the contact area between each segment and the cable. The contact area may vary between segments. For example, in certain embodiments, one segment may have a width greater than the width of another segment. Accordingly, the former segment may provide a greater contribution to the overall performance of the brake pad than the latter segment.

By controlling the composition of the segments, the contact area of the segments, and the gaps between the segments, the performance of a brake pad may be optimized to a given trolley application. For example, in selected embodiments, it may be desirable for a brake pad in accordance with the present invention to slide along a cable. That is, the brake pad may reduce the speed of the trolley along the cable 12, but not overly slow or stop it.

Accordingly, in one embodiment, certain segments may be formed of a first, substantially inelastic material (e.g., high density polyethylene (HDPE), ultra high molecular weight (UHMW) polyethylene, or the like). The rest of the segments may be formed a second, elastic material (e.g., multi-rubber or elastomeric materials such as are used for the caliper brake pads of a bicycle). Elastomers may strip water from a surface, but typically do not wear as well as other polymers. Accordingly, overall, the brake pad may have both acceptable wear and frictional engagement even when applied to a wet cable. By adjusting the number of segments corresponding to the first and second materials and the contact areas associated with those segments, a proper balance of characteristics may be achieved.

In selected embodiments, a trolley in accordance with the present invention may provide a user (e.g. operator, or rider in some circumstances) "on-the-fly" control over the magnitude of a braking force generated by the trolley as it travels along a cable. For example, by adjusting the moment arm (e.g. leverage) at which the weight of a user is applied to the frame of a trolley, the magnitude of the resulting moment may be controlled. The magnitude of the moment may then dictate the magnitude of the normal force against the cable generating the frictional braking force. Accordingly, by adjusting the moment arm at which the weight of a user is applied to the frame of a trolley, a user may control, within a particular range, the speed of the trolley for a particular catenary, or naturally hanging cable.

In selected embodiments, a trolley may include a carriage configured to secure to, operate with, and be adjusted with respect to a frame or portion of a frame throughout a range of motion bounded by a first position of the carriage and a second position of the carriage with respect to the frame. A carriage may move along the frame through the range of motion without compromising the connection between a user and the cable. Accordingly, adjustment of the position of the carriage with respect to the frame, and the resulting adjustment to the braking force, may safely be accomplished in any suitable manner while the trolley including the carriage and frame is in motion along the cable.

In certain embodiments, absent contrary inputs or forces, a carriage may, under the impetus of gravitational acceleration, move toward the second position. At the second position, the braking force may be at a maximum. Accordingly, a trolley in accordance with the present invention may have a default configuration corresponding to maximum braking, which, given typical cable declination, is sufficient to bring the trolley to a halt, such as in the event of any failure of the trolley.

Trolleys in accordance with the present invention may be used as the basis for an amusement ride. For such rides, revenue may largely depend on the number of operators employed to operate the ride and the number of users served within a given period of time. Accordingly, a trolley retrieval system in accordance with the present invention may be configured to maximize user throughput, minimize operator interaction, and increase safety.

In selected embodiments, a trolley retrieval system may include multiple cables held in suspension between first and second supports. A retrieval line may be suspended in an open line or in a closed loop extending from proximate a start area to proximate a finish area. A closed loop is more readily controllable and less likely to tangle or fail to deploy properly. A motivator (e.g. motor) may selectively circulate the retrieval line back and forth or around the loop. A controller may control operation of the motivator.

In certain embodiments, a controller may include a processor and one or more sensors. The sensors may be operably connected to the processor to pass thereto a stop signal informing the processor that one or more of trolleys is sufficiently near the start area. The processor may be programmed to issue, in response to the stop signal, a stop command causing the motivator to cease circulation or other operation of the retrieval line. The processor may be further programmed to issue, in further response to the stop signal, a reverse command causing the motivator to reel in or circulate the retrieval line in an opposite direction when it resumes circulation of the retrieval line. For example, a motive source may comprise an electric motor. In such an embodiment, the controller of such a motivator may include a polarity switch switching, in response to the reverse command, the polarity of the current supplied to the electric motor. A controller may further include a retrieval switch operably connected to cause, when activated, the motivator to resume circulation of the retrieval line.

In operation, an amusement ride in accordance with the present invention may begin with selection of a system comprising one or more cables held in suspension between first and second supports and a trolley positioned to travel along each cable. A user may then be connected to the trolley. Following securement of a user into a harness or possibly of a harness or seat of a user thereto, the trolley may be released to travel along the cable from proximate the start area to proximate the finish area. At the finish area, the user may be disconnected from the trolley. The trolley may then be connected to a retrieval line. Safety will usually favor fastening a user into a harness already connected to the main support cable rather than connecting and disconnecting harnesses and trolleys from a main support cable.

Once a trolley is connected to a retrieval line, the motivator may be activated to draw the trolley along the cable from proximate the finish area to proximate the start area. When one or more of the trolleys connected to a retrieval line activates a sensor, the motivator may stop the retrieval line. The trolley or trolleys may then be disconnected from the retrieval line and secured for future use.

As stated hereinabove, in selected embodiments, a processor may be programmed to issue, in response to a stop signal, a reverse command causing the motivator to circulate the retrieval line in an opposite direction when it resumes circulation of the retrieval line. So configured, the engagement locations between a retrieval line and a trolley may travel in a cycle from the starting (e.g. loading, launching) area to the finishing (e.g. end, unloading) area and back. Moreover, while one engagement location is stopped at the starting area, another may be stopped at the finish area.

Accordingly, while one or more trolleys are being loaded with users, other trolleys may be connected to a retrieval line. Also, while one or more trolleys are towed or pulled back up from the finish area to the start area, other engagement locations on the retrieval line may be returning to the finish to continue the cyclical pattern. So configured, a trolley retrieval system in accordance with the present invention may provide a substantially continuous throughput, minimize operator interaction, and increase safety.

In selected embodiments, an apparatus and method in accordance with the present invention may minimize force loads and distribute impulse loads of arrest in a trolley. In certain embodiments, this method may begin with providing a trolley traveling along a suspended cable. The trolley may be freed to travel down the cable under the impetus of a gravitational force. A braking force may be applied between the trolley and the cable to control the speed of the trolley as it travels along the cable.

When it becomes necessary to stop the trolley (e.g., at the end of the cable), the braking force may be relieved or reduced. In selected embodiments, a portion of the kinetic energy corresponding to the trolley may be used to lift the frame of the trolley and a rider suspended therefrom. This may result in a pivoting of the frame and the desired reducing of the braking force generated by the trolley. Additionally, at least a portion of the kinetic energy corresponding to the trolley may be transferred into a deflecting element deflecting along the direction of the cable. In such an embodiment, the slowing of the trolley may take on the characteristics of the deflecting element, rather than the characteristics of the trolley's on-board brake.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF SELECTED EMBODIMENTS

Figure 1:
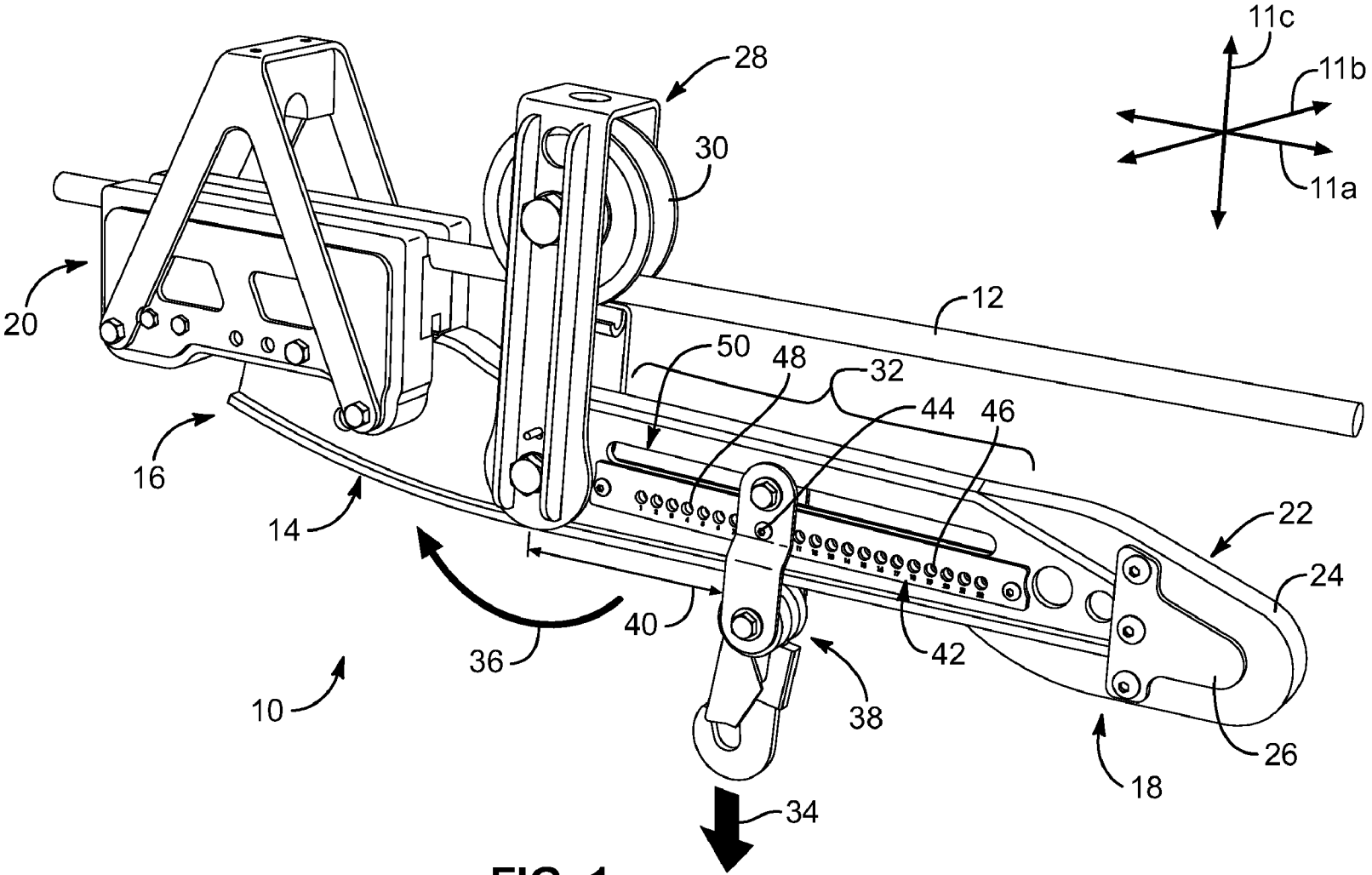
FIG. 1 is a perspective view of one embodiment of a trolley and cable in accordance with the present invention.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIG. 1, in discussing a trolley 10 in accordance with the present invention, it may be advantageous to establish a coordinate system 11. Accordingly, a trolley 10 may be defined in terms of a longitudinal direction 11*a*, a lateral direction 11*b*, and a transverse direction 11*c*, substantially orthogonal to one another.

A trolley 10 in accordance with the present invention may be configured for travel along a cable 12 in the longitudinal direction 11*a*. In general, a trolley 10 of the present invention may be applied to a cable 12 held in suspension by two or more supports. For example, as disclosed in U.S. Pat. No. 6,622,634 issued Sep. 23, 2003 and entitled AMUSEMENT RIDE EMPLOYING A SUSPENDED TENSIONED STATIC CABLE, which is incorporated herein by reference, a cable 12 may be supported between two supports (e.g., towers, platforms). A first support may hold one end of the cable 12 at a higher elevation than a second support holds the other end of the cable 12. Accordingly, a trolley 10 secured to roll along the cable 12 may tend to travel from the first, upper support toward the second, lower support.

While a suspended cable 12 may provide the basis for an amusement ride, other uses are also contemplated. For example, a suspended cable 12 may be used as part of a lift system transporting persons or goods over or up certain geologic obstacles. Suspended cables 12 are commonly used on ski lifts, gondolas, aerial trams, and the like. Similarly, suspended cables 12 have been incorporated into evacuation systems (e.g., oil derrick evacuation systems). Whether for repair, evacuation, or as part of the system itself, such suspended cable 12 systems often require a trolley 10 in accordance with the present invention.

In selected embodiments, a frame 14 may provide the main structure of the trolley 10 or a base to which other components may secure. A frame 14 may be formed of any suitable material or combination of materials. Characteristics that may be considered when selecting the material for the frame 14 may include cost, formability, machineability, strength, rigidity, durability, corrosion resistance, density, etc. In certain embodiments, aluminum has been found to be a suitable material for a frame 14.

A frame 14 may extend from a first end 16 to a second end 18. In certain embodiments, a brake assembly 20 may connect to the frame 14 proximate the first end 16 thereof. Proximate the second end 18, a bumper assembly 22 may connect to the frame 14. In one embodiment, a bumper assembly 22 may include a bumper 24 held between two cheek plates 26. In selected embodiments, a bumper 24 may be formed of a friction-reducing polymeric material (e.g., HDPE, UHMWPE, PTFE). In other embodiments, a bumper 24 may be formed of an elastomeric (e.g. rubber compound) material.

A sheave mount 28 may connect to the frame 14 at a location between the brake assembly 20 and the second end 18. A sheave mount 28 may support one or more sheaves 30 positioned to roll along the cable 12. In selected embodiments, the portion 32 of the frame 14 between the sheave mount 28 and the second end 18 may be characterized as the user-suspension-portion 32. That is, the weight of a user may be directed to, and supported by, this portion 32 of the frame 14.

In certain embodiments, the frame 14 of a trolley 10 in accordance with the present invention may be suspended below a cable 12 in the transverse direction 11*c*. A sheave mount 28 may extend upwardly from the frame 14, positioning a sheave 30 to roll on an upper surface of the cable 12. A brake assembly 20 may extend upwardly from the frame 12 to contact a lower surface of the cable 12. With the brake assembly 20 and user-suspension portion 32 on opposite sides of the sheave mount 28, the weight 34 of a user applied to the user-suspension portion 32 may generate a torque 36 or moment 36 urging the brake assembly 20 to "pitch" against the underside of the cable 12 (i.e., generate or urge rotation about an axis extending in the lateral direction 11*b*). The greater the moment 36 generated, the greater the braking force or friction force produced by the brake assembly 20.

A carriage 38 may provide the primary interface between a user and a trolley 10 in accordance with the present invention. That is, while other locations, apertures, connection, structures, and the like may be used for redundant, fail-safe systems, in normal use, the majority of user weight 34 may be applied to the carriage 38. The carriage 38, in turn, may communicate that load to the frame 14.

The position of the carriage 38 with respect to the frame 14 may be adjusted to provided a desired braking force. For example, the greater the distance 40 between the sheave mount 28 and the carriage 38, the greater the moment 36 and resulting braking force. The opposite may also be true. That is, the braking force may be minimized by minimizing the moment arm 40 over which the weight 34 of a user may act.

Adjustability and securement between a carriage 38 and a frame 14 may be provided by any suitable structures. In selected embodiments, an array of apertures 42 may provide an array of positions at which a carriage 38 may be secured to a frame 14. A pin 44 or bolt 44 may pass through a carriage 38 and a selected aperture of the array 42 to lock the carriage 38 at a desired moment arm 40. Accordingly, a trolley 10 in accordance with the present invention may be tuned to a particular cable 12 arrangement. That is, a trolley 10 may be formed according to a single design, yet be flexible within that design to provide braking appropriate for a wide range of cable 12 arrangements.

For example, given a first cable 12 arrangement involving a comparatively larger change in elevation, a trolley 10 traveling on such a cable 12 may tend to reach excessive speeds. Thus, the carriage 38 may be secured to the frame 14 at an aperture 46 in the array of apertures 40 providing a corresponding, comparatively larger moment arm 40. This greater moment arm 40 may increase the braking force and keep the trolley 10 within acceptable speed ranges.

Conversely, consider a second cable 12 arrangement involving a minimal change in elevation. For such an arrangement, a carriage 38 secured at certain apertures (e.g., aperture 46) may provided excessive braking. For example, the resultant braking may cause the trolley 10 to stop without reaching the unloading area at the bottom of the cable 12. According, for such arrangements, a carriage 38 may be secured to the frame 14 at an aperture 48 in the array of apertures 40 providing a minimal moment arm 40. By so positioning the carriage 38, the trolley 38 may provide greater speed along the cable 12.

While the weights of different users may vary, a trolley 10 in accordance with the present invention may automatically compensate for such variations. For example, the braking force required to regulate the speed of a trolley 10 carrying a user weighing 200 lbs. may be significantly greater than the braking force required to regulate the speed of a trolley 10 carrying a user weighing 100 lbs. However, with a single setting of the carriage 38 (i.e., a single moment arm 40), at trolley 10 may appropriately regulate the speed of both users.

The braking force generated by a trolley 10 is equal to the coefficient of friction between the brake assembly 20 and the cable 12 multiplied by the normal force urging the braking assembly 20 against the cable 12. For a single moment arm 40, the only variable becomes the weight 34 of the user. Accordingly, the normal force urging the braking assembly 20 against the cable 12, which is result of the moment 36 applied by the weight 34 of a user to the frame 14, controls the braking force. Thus, without adjusting the position of the carriage 38, the braking force generated for a user weighing 200 lbs. user will automatically be roughly twice that generated for a user weighing 100 lbs. That is, a trolley 10 may be tuned to a particular cable 12 arrangement, but need not be tuned for each user.

A trolley 10 in accordance with the present invention may include any desirable redundant or fail-safe systems. For example, in selected embodiments, a frame 14 may include a slot 50 within or along which the carriage 38 may travel. Accordingly, if the pin 44 holding the carriage 38 in a particular location were to fail, the carriage 38 would not be free to separate from the frame 14. Additionally, the orientation of the slot 50 with respect to the weight 34 of a user may urge an unpinned carriage 38 toward the end of the slot 50 corresponding to the second end 18 of the frame 14. At such a location, the moment arm 40 and corresponding braking force may be at a maximum. Accordingly, if a pin 44 were to fail, the link between the user and the cable 12 would not be lost and the trolley 10 would quickly be brought to a halt.

Figure 2:
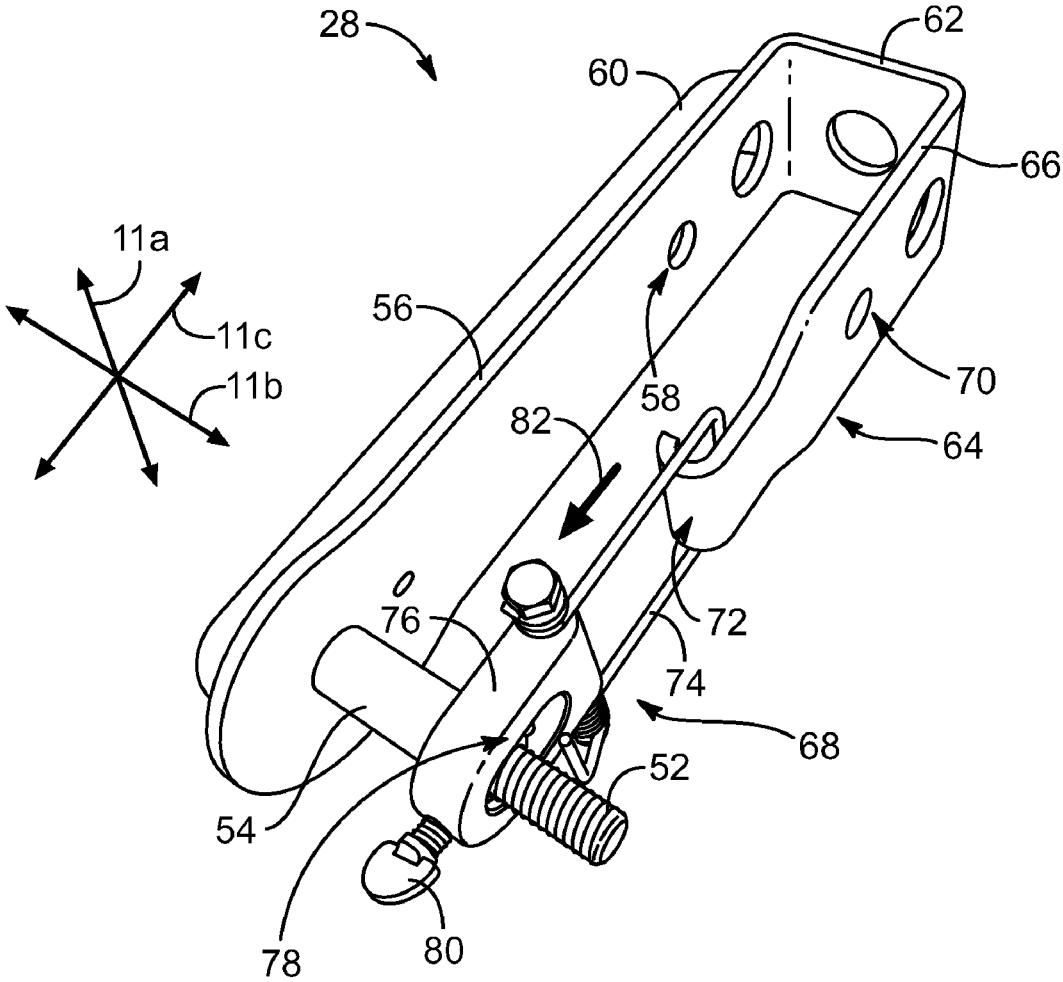
FIG. 2 is a perspective view of one embodiment of a sheave mount from a trolley in accordance with the present invention.

Referring to FIG. 2, in selected embodiments, a sheave mount 28 in accordance with the present invention may be pivotably secured to a frame 14. For example, in certain embodiments, a bolt 52 may extend through the frame 14. If desired, a collar 54 may be positioned over the bolt 52 to improve wear resistance, increase the rigidity of the bolt 52, or the like.

In certain embodiments, to increase safety, a sheave mount 28 may provide an enclosure capturing a cable 12 therewithin. That is, once the sheave mount 28 has received a cable 12 therewithin, it may resist inadvertent removal of that cable 12. For example, in one embodiment, a sheave mount 28 may include a first side 56 extending from the bolt 52 to an aperture 58 for supporting a sheave 30. This first side 56 may include one or more ribs 60 to increase the rigidity and strength thereof. A top 62 of the sheave mount 28 may connect the first side 56 to a second side 64 of the sheave mount 28. In selected embodiments, the second side 64 may control admittance and release of a cable 12 from within the sheave mount 28.

In selected embodiments, the second side 64 of a sheave mount 28 may be separated into a hook portion 66 and a bail assembly 68. In one embodiment, the hook portion 66 may be connected to the top 62 and include an aperture 70 that, in combination with another aperture 58, may pivotably connect a sheave 30 to the sheave mount 28. A hook portion 66 may also include a hook 72.

A bail assembly 68 may include a bail 74 and a bail mount 76. A bail mount 76 may connect to the bolt 52 or collar 54 extending through the frame 14 from the first side 56 of the sheave mount 28. A bail 74 may, in turn, extend from the bail mount 76 to engage the hook 72 of the hook portion 66. In selected embodiments, a bail 74 may be biased toward a closed position with respect to the hook 72. Accordingly, in certain embodiments, a bail 74 may be moved (e.g., pivoted) to permit entry of a cable 12 into the sheave mount 28. Once the cable 12 is captured with the sheave mount 28, the bail 74 may be released to return automatically to its preferred (biased), closed position.

In selected embodiments, the interface between a bail 74 and a hook 72 may be such that the bail 74 is configured to open only toward the interior of the sheave mount 28. Thus, the bail 74 may be biased to permit entry of a cable 12 into the sheave mount 28 but resist inadvertent removal of that cable 12. As an additional safety feature, in certain embodiments, a bail mount 76 may include a slotted aperture 78 extending therethrough to receive the bolt 52, collar 54, or some combination thereof. A tensioner 80 may control the position of the bolt 52, collar 54, etc. within the slotted aperture 78.

Accordingly, once a cable 12 has been received within a sheave mount 28 and the bail 74 has returned to a closed position, the tensioner 80 may be adjusted to move the bail assembly 68 with respect to the bolt 52, collar 54, etc. Thus, the bail 74 may be pulled 82 firmly into engagement with the hook 72. In such an arrangement, the hook 72 may resist opening of the bail 74. Additionally, the bail assembly 68 may assist in transferring loads from a sheave 30 to the frame 14 of the trolley 10. That is, the first side 56 of the sheave mount 28 need not act alone, thereby increasing the load-bearing capacity, and corresponding safety factor, associated with the sheave mount 28.

Figure 3:
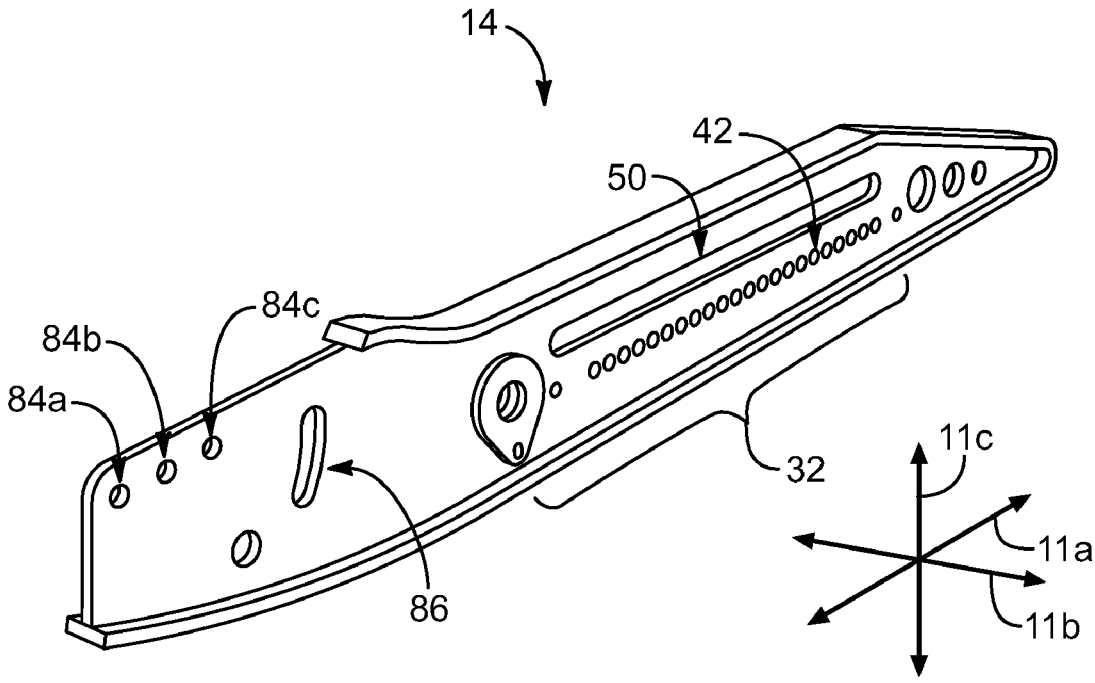
FIG. 3 is a perspective view of one embodiment of a frame from a trolley in accordance with the present invention.

Referring to FIG. 3, in selected embodiments, a trolley 10 in accordance with the present invention may include a brake assembly 20 that is pivotably secured to the frame 14. A pivotable connection between a brake assembly 20 and a frame 14 may support a more controlled and even wear on the break assembly 20.

In certain embodiments, to provide a pivoting securement between a brake assembly 20 and a frame 14, the frame 14 may include various apertures 84, 86. A pivot aperture 84 may be sized and shaped to receive a pivot bolt (i.e., a bolt about which the brake assembly 20 may pivot). A limiting aperture 86 may be sized and shaped to receive a limiting bolt (i.e., a bolt moving with the brake assembly 20 and abutting the extremes of the limiting aperture 86 when the brake assembly 20 reaches a desired limit to its pivoting).

In selected embodiments, a frame 14 may include multiple pivoting apertures 84*a*, 84*b*, 84*c*. For example, a first pivoting aperture 84*a* may provide a pivot point (e.g., central pivot point) for a brake assembly 20 of a first size. A second pivoting aperture 84*b* may provide a pivot point for a brake assembly 20 of a second, smaller size. A third pivoting aperture 84*c* may provide a pivot point for a brake assembly 20 of a third, even smaller size. If desired, multiple limiting apertures 86 may be provided. In one embodiment, however, a single limiting aperture 86 may be sized and shaped to providing a limiting effect to brake assemblies 20 pivoting in any of the various pivoting apertures 84.

Figure 4:
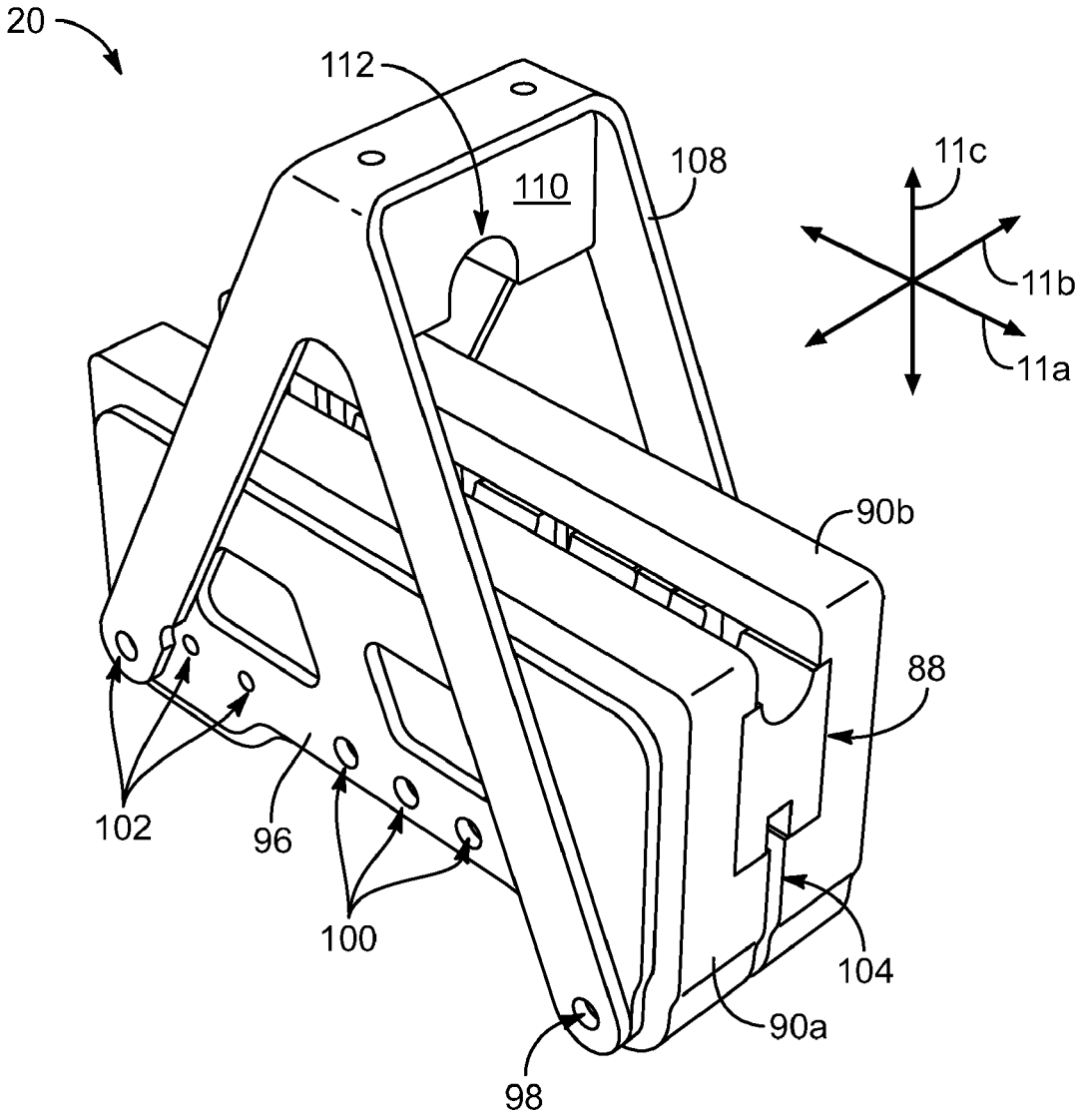
FIG. 4 is a perspective view of a brake assembly from a trolley in accordance with the present invention.
Figure 5:
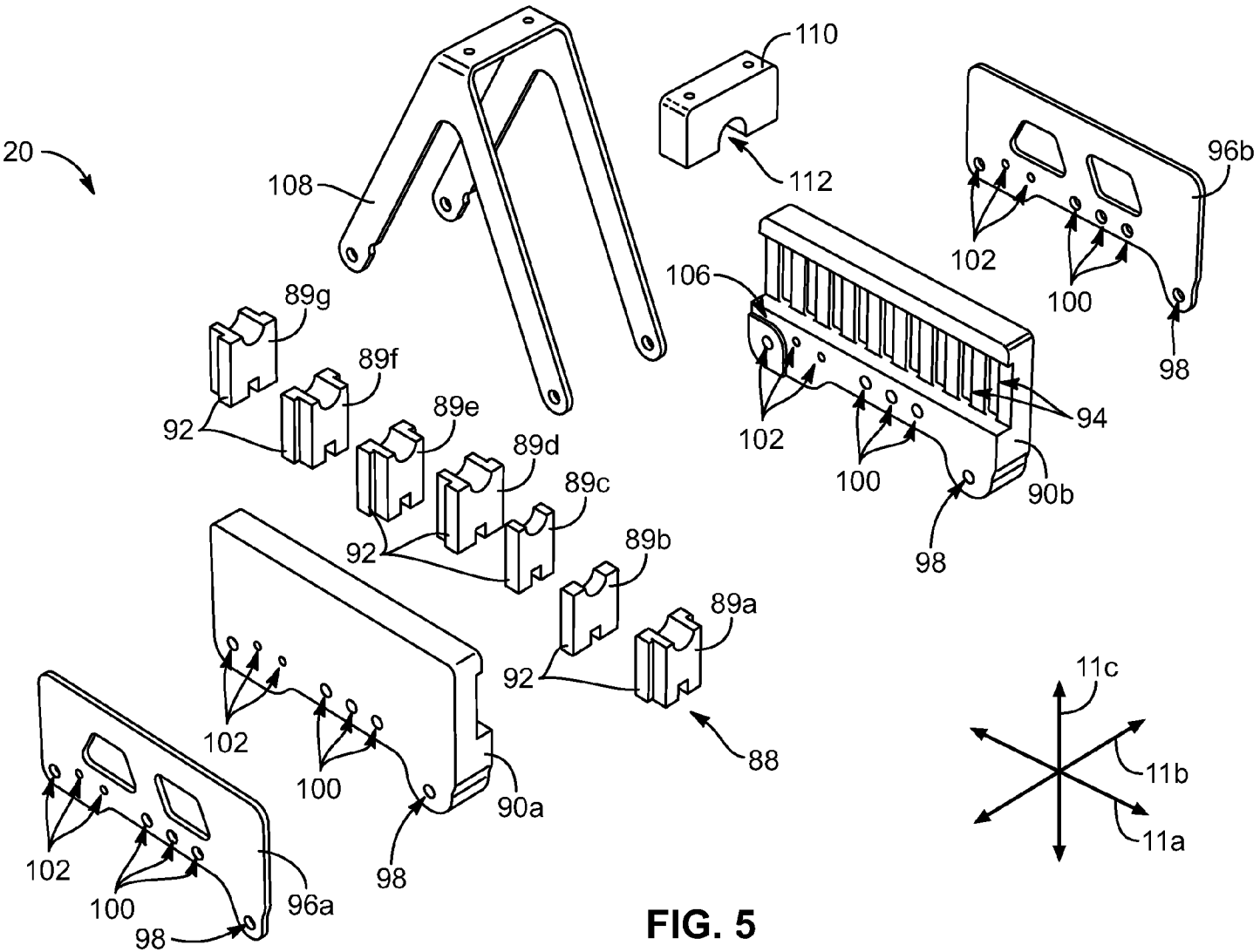
FIG. 5 is an exploded view of the brake assembly of FIG. 4.

Referring to FIGS. 4 and 5, a brake assembly 20 in accordance with the present invention may provide significant adjustability. For example, a brake assembly 20 may include a brake pad 88 that may be removed and replaced, as wear so dictates. Additionally, a brake pad 88 may itself be adjustable to provide a desired or customized braking effect. In selected embodiments, a brake pad 88 may comprise a plurality of interchangeable brake pad segments 89. Thus, the sequence, composition, gaps, and the like of the various segments 89 may be selected to provide a desired resistance to wear, frictional coefficient, all-weather braking, and the like.

In certain embodiments, the various segments 89 of a brake pad 88 may be held in place by one or more brake shoes 90. For example, in one embodiment, a first brake shoe 90*a* may engage one side of the brake pad 88, while a second brake shoe 90*b* may engage the other side of the brake pad 88. Accordingly, in such an embodiment, the brake shoes 90 may securely hold the brake pad 88 therebetween.

In selected embodiments, the brake pad 88 and one or more brake shoes 90 may be configured to facilitate mutual engagement. For example, in one embodiment, the various segments 89 of a brake pad 88 may include one or more extensions 92. The brake shoes 90 may include one or more recesses 94 shaped and sized to receive the extensions 92. Accordingly, when assembled, the brake shoes 90 may secure the brake pad 88 in all three dimensions 11*a*, 11*b*, 11*c*.

If desired or necessary, a brake assembly 20 may include various structural members providing additional strength, rigidity, safety, or the like. For example, in selected embodiments, a brake assembly 20 may include one or more cheek plates 96. In one embodiment, a brake assembly 20 may include a first cheek plate 96*a* positioned to reinforce a first brake shoe 90*a* and a second cheek plate 96*b* positioned to reinforce a second brake shoe 90*b*.

In certain embodiments, a cheek plate 96 may include various apertures to support desired functionality. For example, a cheek plate 96*a* may include an aperture 98 sized and positioned to receive a limiting bolt, one or more apertures 100 sized and positioned to receive a pivot bolt, and one or more apertures 102 sized and positioned to receive assembly bolts or bolts securing the brake assembly 20 together. In selected embodiments, corresponding apertures 98, 100, 102 may be formed in other cheek plates 96*b*, as well as the various brake shoes 90.

In selected embodiments, a brake assembly 20 may include a groove 104 or slot 104 sized and positioned to accommodate a portion of the frame 14 therewithin. Accordingly, in such embodiments, a brake assembly 20 may effectively straddle the frame 14, permitting various fasteners (e.g., pivot bolts, limiting bolts, etc.) to pass through both the brake assembly 20 and the frame 14. If desired or necessary, a slot 104 may extend some distance less than the entire length of the brake assembly 20. For example, in one embodiment, opposing brake shoes 90*a*, 90*b* may each include a shoulder 106 extending to meet the other. The shoulders 106 may effectively close the slot 104. Accordingly, any fastener (e.g., assembly bolt) passing through the area of the shoulder 106 may be tightened without clamping the frame 14 and reducing the ability of the brake assembly 20 to pivot with respect to the frame 14.

A brake assembly 20 in accordance with the present invention may include a capture 108. A capture 108 may secure a cable 12 therewithin. That is, once a trolley 10 is applied to a cable 12, the capture 108 may secure the brake assembly 20 to the cable 12. Accordingly, the capture 108 may provide a redundant safety mechanism and, should there be a catastrophic failure of the sheave mount 28, the trolley 10 may be secured to the cable 12 via the brake assembly 20 and capture 108.

If desired, a capture 108 may include a slide 110. In certain embodiments, a slide 110 may provide an interface between a capture 108 and a cable 12. For example, a capture 108 may in certain situations slide along a cable 12. In such situations, a slide 110 may prevent abrasion or grinding that may reduce the structural integrity of the capture 108. In one embodiment, a slide 110 may include a groove 112 or slot 112 providing a preferred or default location of engagement between a slide 110 and a cable 12, should contact occur therebetween.

Figure 6:
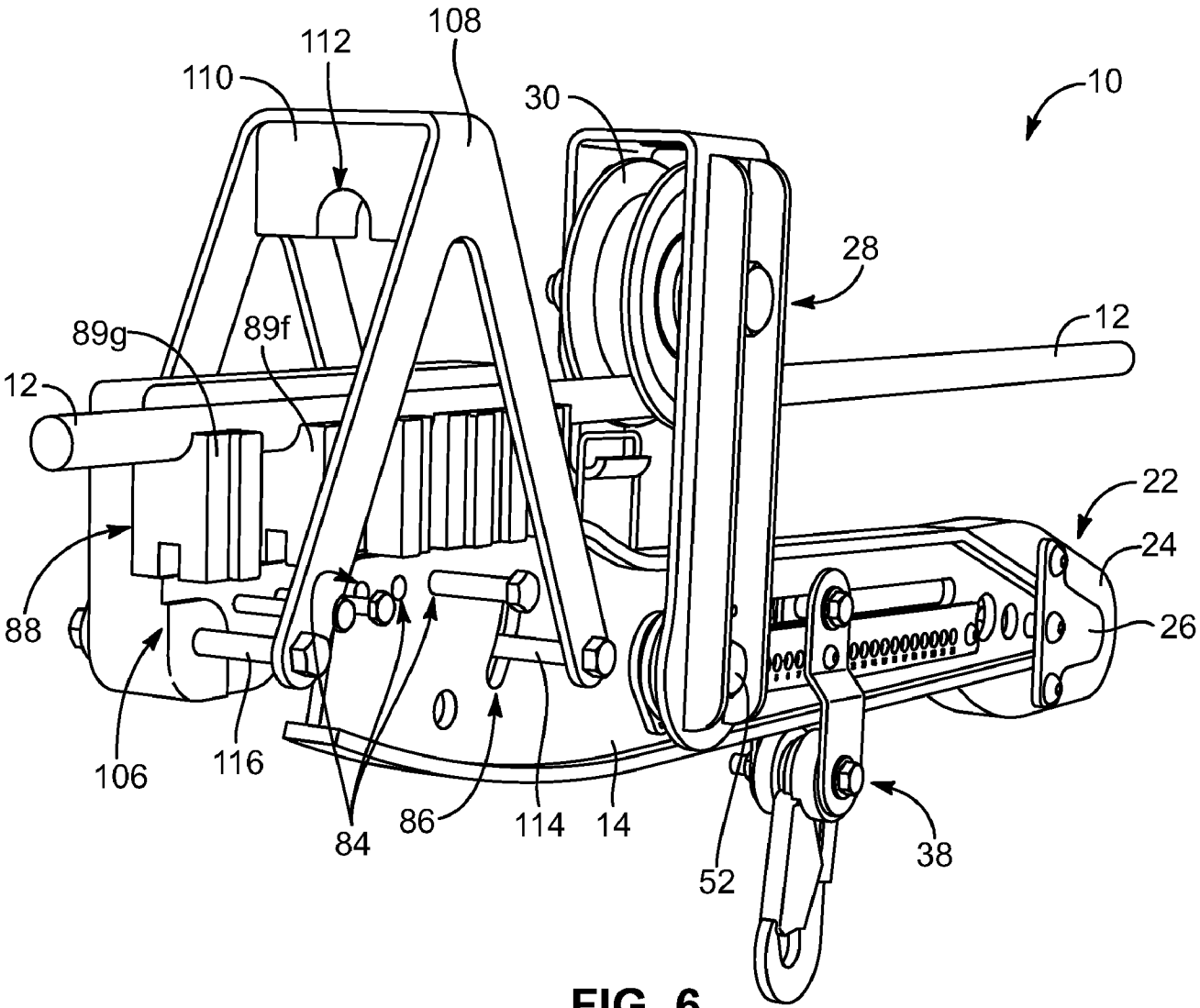
FIG. 6 is a perspective view of the trolley of FIG. 1, omitting a cheek plate and brake shoe of the brake assembly.

Referring to FIG. 6, a capture 108 in accordance with the present invention may have any suitable shape or configuration. Additionally, a capture 108 may secure to the rest of the brake assembly 20 in any suitable manner. For example, in one embodiment, a capture 108 may be positioned and secured to bracket the rest of the brake assembly 20. Such bracketing may improve the structural integrity of the brake assembly 20 without requiring additional fasteners (e.g., bolts), which may interfere with the adjustability or functionality of the brake assembly 20. Portions of the capture 108 may be held in place by one or more bolts extending in the lateral direction 11*b* through the brake assembly 20. For example, in one embodiment, a capture 108 may be held in place by a limiting bolt 114 and an assembly bolt 116.

Figure 7:
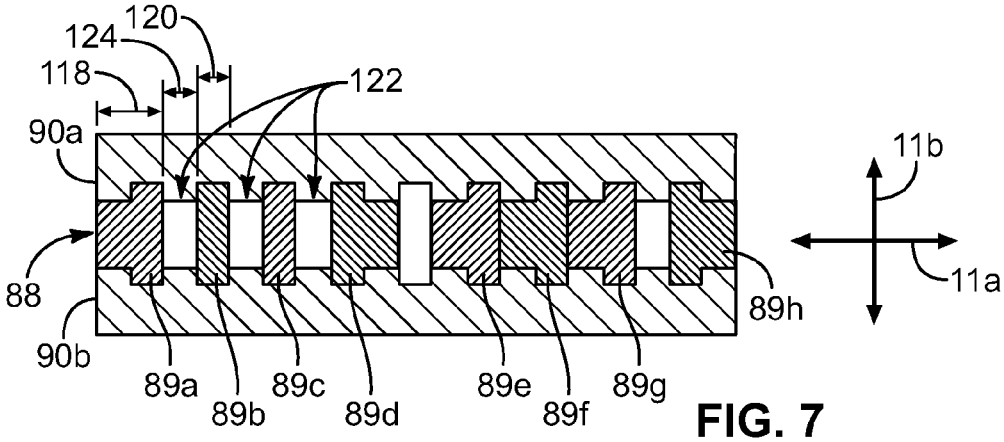
FIG. 7 is a top, plan, cross-sectional view of one embodiment of a brake pad and brake shoes in accordance with the present invention.

Referring to FIG. 7, various material properties and characteristics may be considered when selecting a material for a brake pad 88 in accordance with the present invention. Properties and characteristics that may be considered include cost, availability, machineability, wear resistance, toughness, all weather performance (e.g., characteristics at various conditions of humidity, moisture, corrosion, temperature, and the like), coefficient of friction against a cable 12 in various weather conditions (e.g., temperature and wetness levels), and the like. Often a material that has certain advantageous characteristics may have others that are disadvantageous. For example, one material may have excellent wear resistance, but its coefficient of friction against a cable 12 may vary greatly depending on whether the cable is dry. Accordingly, the material may be suitable for dry conditions, yet be hazardous for wet conditions.

In certain embodiments of a trolley 10 in accordance with the present invention, it may be advantageous to provide a brake pad 88 having repeatable and consistent performance with respect to wear, coefficient of friction, or the like regardless of temperature, wetness, etc. For example, by providing a brake pad 88 with consistent wear, fixed maintenance schedules may be determined and executed. The resulting decrease in subjectivity may be accompanied by an increase in consistency and safety. Similarly, by providing a brake pad 88 with a consistent coefficient of friction regardless of the wetness of the cable 12, rain need not concern an operator of a trolley 10 in accordance with the present invention. Again, the resulting decrease in subjectivity and weather dependence may be accompanied by an increase in consistency and safety.

In selected embodiments, a brake pad 88 may be configured to operate within a specific range. For example, a brake pad 88 may perform within a range, regardless of environmental temperature and the wetness or dryness of a cable 12. A brake pad 88 may deliver a rider to the bottom end of a cable 12 at a first speed in a dry environment at 90 degrees Fahrenheit. That same brake pad 88 may deliver a rider to the bottom end of a cable 12 at a second speed, different from the first speed, in a wet (e.g., saturated cable 12) environment at 65 degrees Fahrenheit. However, the difference between the first and second speeds may be such that both are within an acceptable range. For example, while the first may be 20 miles per hour and the second may be 27 miles per hour, both speeds may be below a hypothetical safety cutoff of 35 miles per hour.

To provide the advantages of a brake pad 88 in accordance with the present invention, a brake pad 88 may be formed of various segments 89 The various segments 89 may be formed in various shapes and of various materials. As stated hereinabove, the shape of the various segments 89 may support engagement with the rest of the brake assembly 20 (e.g., the brake shoes 90). The shape of the various segments 89 may also control the contact area between a segment 89 and a cable 12.

In selected embodiments, a brake pad 88 may include a plurality of segments 89 positioned in series. So positioned, the width of each segment 89 in the longitudinal direction 11*a* may control the contact area between each segment 89 and the cable 12. The contact area may vary between segments 89. For example, in certain embodiments, one segment 89*a* may have a width 118 greater than the width 120 of another segment 89*b*. Accordingly, the former segment 89*a* may provide a greater contribution to the overall performance of the brake pad 88 than the latter segment 89*b*. Although friction forces are independent from the area engaged, wear is not.

If desired, gaps 122 may be included between various segments 89 of a brake pad 88. In certain embodiments, gaps 122 may improve the all weather performance of a brake pad 88. For example, when a cable 12 is saturated with water, the gaps 122 may provide locations for the water to escape from between the cable 12 and a segment 89 being pressed thereagainst. The size 124 or width 124 of the gaps 122 in a brake pad 88 may vary from a minimum of direct abutment between adjacent segments (e.g., segment 89*a* and segment 89*b*) to some maximum.

By controlling the composition of the segments 89, the contact area of the segments 89, and the gaps 122 between the segments 89, the performance of a brake pad 88 may be optimized to a given trolley 10 application. For example, in selected embodiments, it may be desirable for a brake pad 88 in accordance with the present invention to slide along a cable 12. That is, the brake pad 88 may lower the speed of the trolley 10 along the cable 12, but not overly slow or stop it. Accordingly, in one embodiment, certain segments 89*a*, 89*c*, 89*e*, 89*g* may be formed of a first, substantially inelastic material (e.g., high density polyethylene (HDPE) or ultra high molecular weight polyethylene (UHMWPE)). The rest of the segments 89*b*, 89*d*, 89*f*, 89*h* may be formed a second, elastic material (e.g., multi-rubber or other natural or synthetic elastomeric materials such as those used for the caliper brake pads of a bicycle).

So arranged, the first material may provide the desired wear resistance and a suitable (e.g., limited) frictional engagement with a dry cable 12. The second material may not wear as well as the first material, yet provide a suitable water stripping or frictional engagement with a wet cable 12. Accordingly, overall, the brake pad 88 may have both acceptable wear and frictional engagement even when applied to a wet cable 12. By adjusting the number of segments 89 corresponding to the first and second materials and the contact areas associated with those segments 89, a proper balance of characteristics may be achieved.

Figure 8:
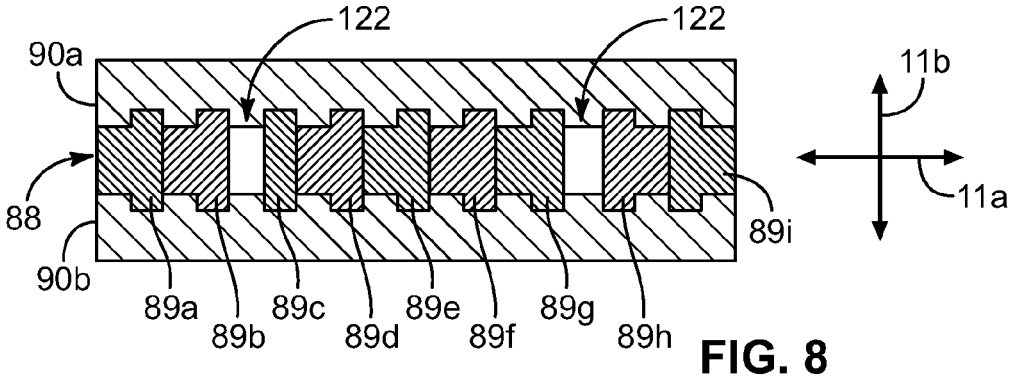
FIG. 8 is a top, plan, cross-sectional view of an alternative embodiment of a brake pad and brake shoes in accordance with the present invention.

Referring to FIG. 8, in selected embodiments, two materials and two larger gaps 122 may be all that is required to provide a satisfactory brake pad 88. Additionally, for optimum performance, the contact area between the two materials may only slightly favor one material over the other. In such an embodiment, a first plurality of segments 89*a*, 89*c*, 89*e*, 89*g*, 89*i* may be formed of a first material. A second plurality of segments 89*b*, 89*d*, 89*f*, 89*h* may be formed of a second material. If desired, the segments 89 may be positioned in an alternating pattern. Accordingly, each segment 89 of the second material may be positioned between segments 89 corresponding to the first material.

Alternatively, the segments 89*a*, 89*c*, 89*e*, 89*g*, 89*i* comprising the first material may be positioned adjacent one another, and the segments 89*b*, 89*d*, 89*f*, 89*h* comprising the second material may be positioned adjacent one another. In such an embodiment, the segment 89*a*, 89*c*, 89*e*, 89*g*, 89*i* comprising the first material may be consolidated into a single monolithic (i.e., seamless) unit. Similarly, the segments 89*b*, 89*d*, 89*f*, 89*h* comprising the second material may be consolidated into a single monolithic unit.

Figure 9:
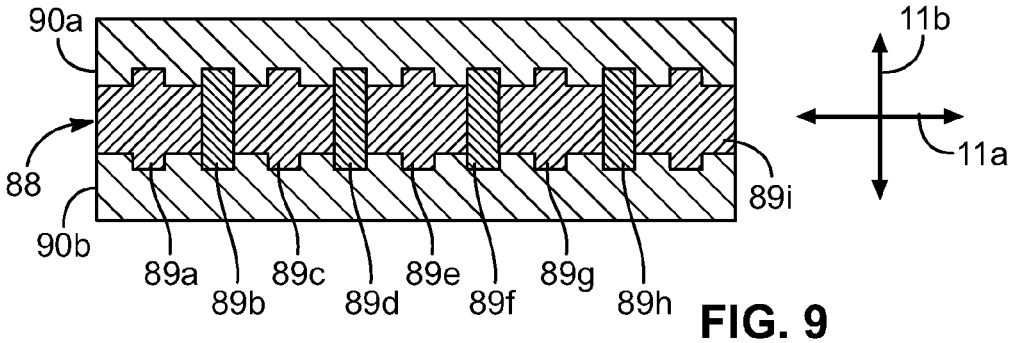
FIG. 9 is a top, plan, cross-sectional view of another alternative embodiment of a brake pad and brake shoes in accordance with the present invention.

Referring to FIG. 9, in selected embodiments, two materials and minimal gaps 122 may be all that is required to provide a satisfactory brake pad 88. Additionally, for optimum performance, the contact area between the two materials may favor one material over the other (e.g., 75 percent one material, 25 percent another). In such an embodiment, a first plurality of segments 89*a*, 89*c*, 89*e*, 89*g*, 89*i* may comprise a first material. A second plurality of segments 89*b*, 89*d*, 89*f*, 89*h* may comprise a second material. Again, the segments 89 may be positioned in an alternating pattern. Alternatively, the segments 89*a*, 89*c*, 89*e*, 89*g*, 89*i* comprising the first material may be positioned adjacent one another and the segments 89*b*, 89*d*, 89*f*, 89*h* comprising the second material may be positioned adjacent one another. Adjacent segments 89 of common material may be consolidated as desired.

Figure 10:
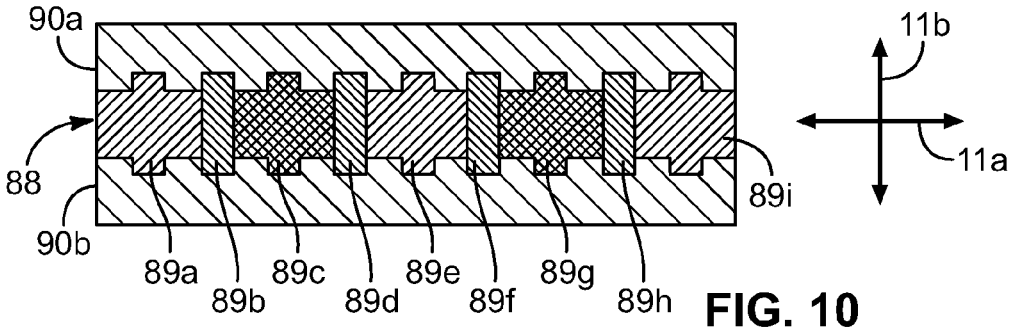
FIG. 10 is a top, plan, cross-sectional view of another alternative embodiment of a brake pad and brake shoes in accordance with the present invention.

Referring to FIG. 10, in selected embodiments, more than two materials 122 may be required to provide an optimal brake pad 88. For example, for optimum performance, three materials may be needed in varying degrees (e.g., contact area comprising 45 percent of a first material, 30 percent of a second material, and 25 percent of the last material). In such an embodiment, a first plurality of segments 89*a*, 89*e*, 89*i* may comprise a first material. A second plurality of segments 89*c*, 89*g* may comprise a second material. A third plurality of segments 89*b*, 89*d*, 89*f*, 89*h* may comprise a third material. Again, the segments 89 may be positioned in an alternating or distributed (e.g., balanced) pattern. Alternatively, the segments 89 may be separated and arranged by material type, and, if desired, consolidated into a minimum number of segments 89 (e.g., only one segment 89 for each type of material).

Figure 11:
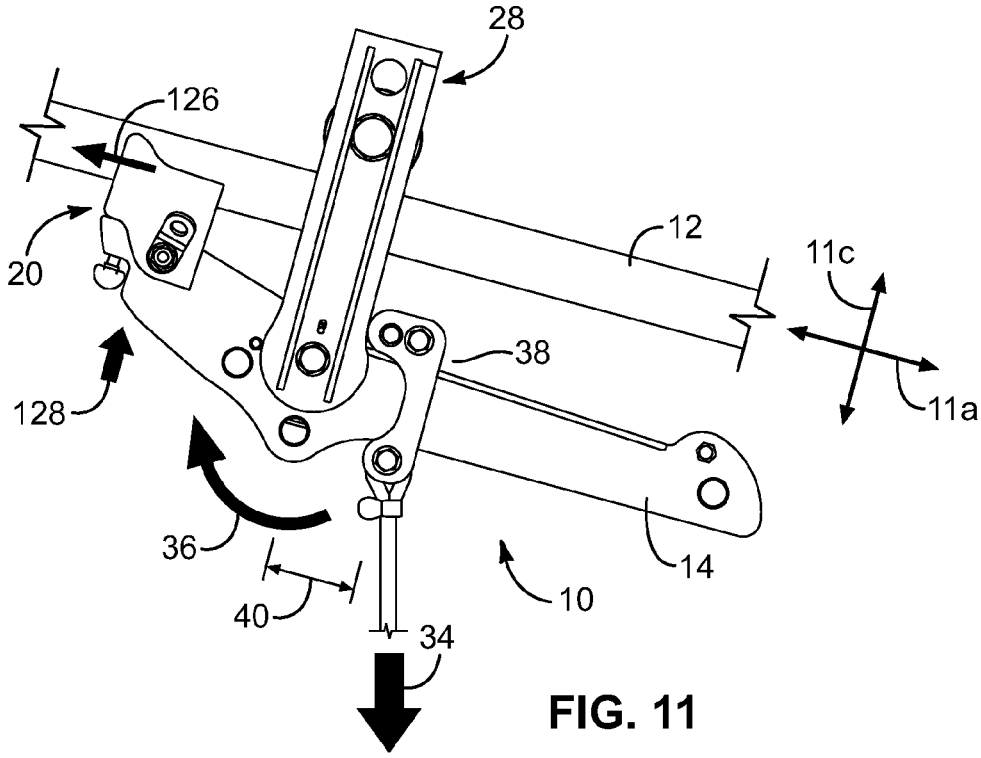
FIG. 11 is a side, elevation view of an alternative embodiment of a trolley applying to a cable minimum braking in accordance with the present invention.
Figure 12:
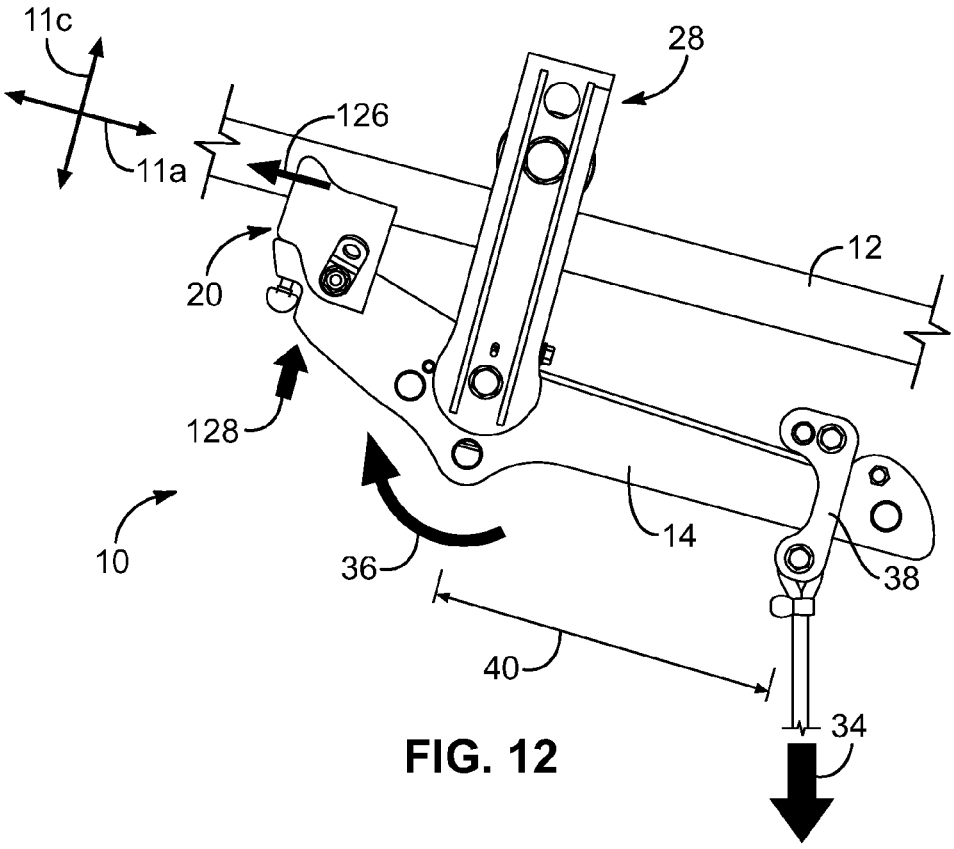
FIG. 12 is a side, elevation view of the trolley of FIG. 11 applying to a cable maximum braking in accordance with the present invention.

Referring to FIGS. 11 and 12, in selected embodiments, a trolley 10 in accordance with the present invention may provide a user readily adjustable, or even "on-the-fly," control over the magnitude of a braking force 126 or friction force 126 generated by the trolley 10 as it travels along a cable 12. The braking force 126 may be equal to the normal force 128 urging the brake assembly 20 against the cable 12 multiplied by the friction coefficient for the brake pad 88 against the cable 12. With the friction coefficient for the brake pad 88 against the cable 12 being substantially constant, the braking force 126 may perhaps most easily be manipulated by manipulations of the normal force 128.

For example, by adjusting the moment arm 40 at which the weight 34 of a user is applied to the frame 14 of a trolley 10, the magnitude of the resulting moment 36 may be controlled. The magnitude of the moment 36 may then dictate the magnitude of the normal force 128. Accordingly, by adjusting the moment arm 40 at which the weight 34 of a user is applied to the frame 14 of a trolley 10, a user may control, within a particular range, the braking force 126 generated by the trolley 10.

In selected embodiments, a trolley 10 in accordance with the present invention may include a carriage 38 configured to travel along a frame 14 or portion of a frame 14 through a range (e.g., continuous range) of motion bounded by a first position of the carriage 38 proximate the sheave mount 28 (e.g., the position of the carriage 38 in FIG. 11) and a second position of the carriage 38 proximate a second end 18 of the frame 14 (e.g., the position of the carriage 38 in FIG. 12).

In certain embodiments, a carriage 38 may travel along the frame 14 through the range of motion bounded by the first and second positions without compromising the connection between a user and the cable 12. Accordingly, adjustment of the position of the carriage 38, and the resulting adjustment to the braking force 126, may safely be accomplished in any suitable manner while the trolley 10 is in motion along the cable 12. That is, in selected embodiments, neither a stopped trolley 10 nor any change in the connection between a user and a cable 12 may be necessary to transition from minimum leverage and braking to maximum leverage and braking.

In selected embodiments, the default position of a carriage 38 with respect to the frame 14 may be the second position (e.g., the position of the carriage 38 in FIG. 12). That is, absent contrary inputs or forces, a carriage 38 may, under the impetus of gravitational acceleration, move toward the second position. At the second position, the braking force 126 may be at a maximum. Accordingly, a trolley 10 in accordance with the present invention may have a default configuration corresponding to maximum braking, which, given typical cable 12 declination, is sufficient to bring the trolley 10 to a halt.

Figure 13:
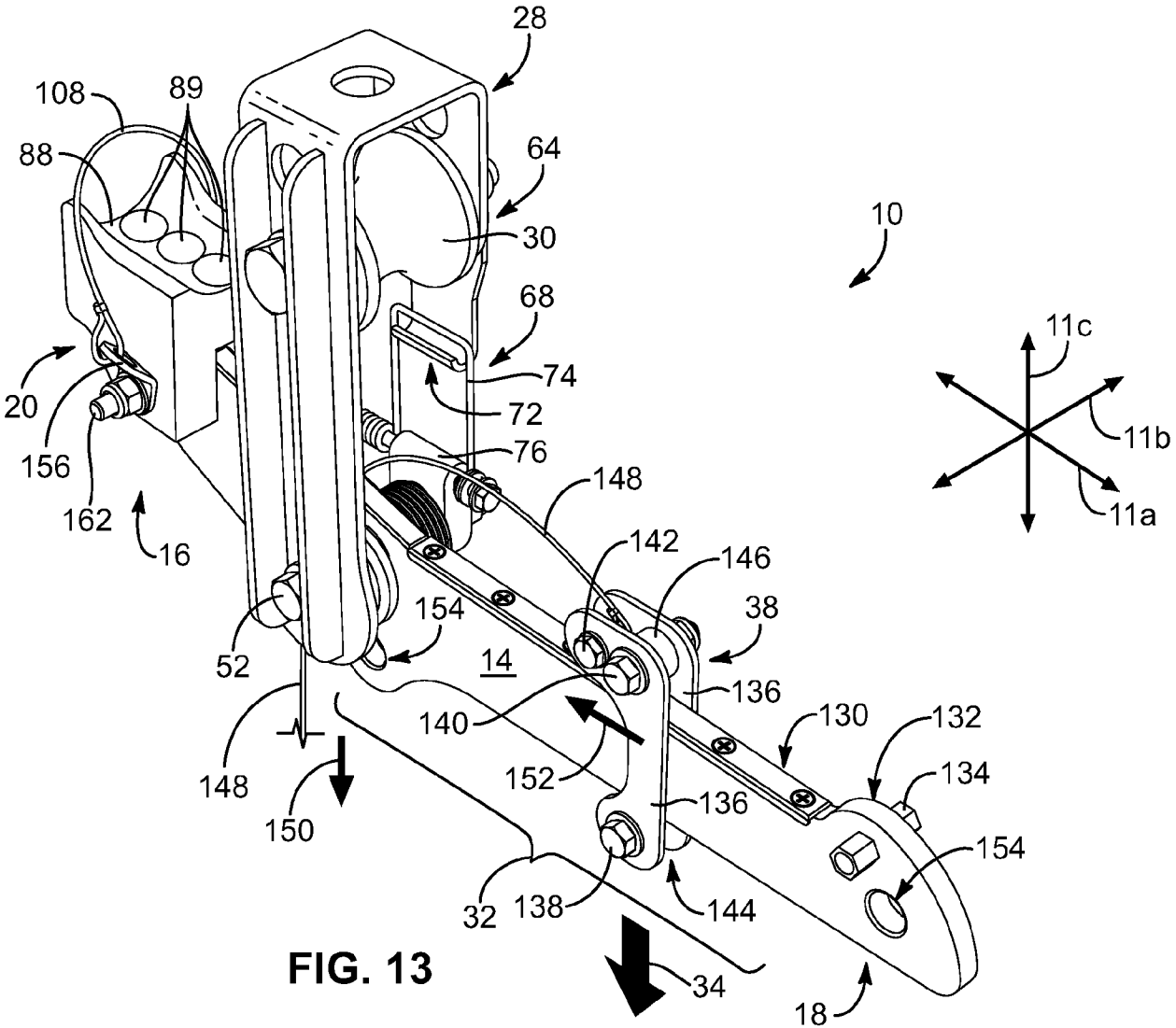
FIG. 13 is a perspective view of the trolley of FIG. 11.
Figure 14:
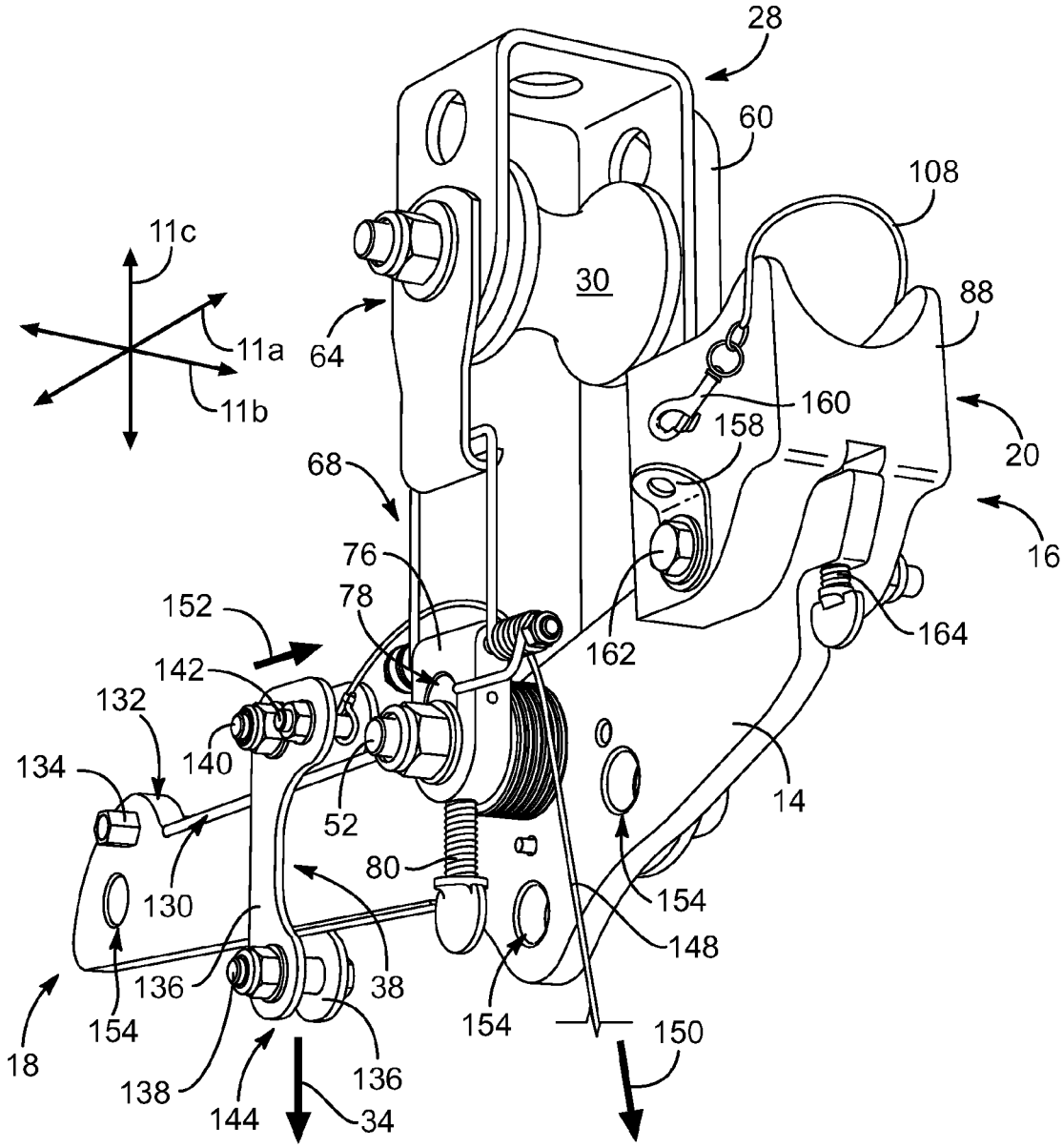
FIG. 14 is another perspective view of the trolley of FIG. 11.

Referring to FIGS. 13 and 14, in selected embodiments, a trolley 10 in accordance with the present invention may be configured to facilitate travel of the carriage 38 along the user-suspension portion 32 of the frame 14. For example, in selected embodiments, a frame 14 may include a rail 130 to provide a suitable surface over which a carriage 38 may travel. In certain embodiments, a rail 130 may provide a substantially planar surface. If desired, a rail 130 may be formed of a material dissimilar from the rest of the frame 14. For example, in embodiments where the frame 14 may be formed of aluminum, a rail 130 formed of steel may be connected to the frame 14 to provide a more durable surface over which a carriage 38 may travel.

A trolley 10 may be configured to resist removal of a carriage 38 from the frame 14. For example, in selected embodiments, a sheave mount 28 may prevent a carriage 38 from passing therebeyond (e.g., beyond the first position). Similarly, the second end 18 of the frame 14 may be configured to prevent a carriage 38 from passing therebeyond (e.g., beyond the second position). For example, in certain embodiments, the second end 18 of the frame 14 may be shaped to include a rise 132 extending transversely 11*c* from the frame to resist passage of the carriage 38 thereover. Also, in some embodiments, the second end 18 of a frame 14 may include a stop 134 (e.g. bolt, pin, etc.) extending laterally 11*b* from the frame to block passage of the carriage 38.

In certain embodiments, a carriage 38 may include two cheek plates 136 bracketing the frame 14. Various fasteners 138, 140, and 142 may extend between the cheek plates 136 to connect the plates 136 together. Such fasteners 138, 140, 142 may also support various functions of a carriage 38. For example, one fastener 138 may provide a user mount 144 or a location 144 at which a user may connect to or tie into the carriage 38 and transfer his or her weight 34 thereto. Another fastener 140 may support a roller 146, bushing 146, or bearing 146 facilitating travel of the carriage 38 along the rail 130. Yet another fastener 142 may provide a structure supporting manipulation of the carriage 38 along the rail 130.

For example, in selected embodiments, a fastener 142 may provide a location for a tether 148 to engage the carriage 38. If desired, a tether 148 may extend from the carriage 38, over the pivot 52, bolt 52, or fastener securing the sheave mount 28, and down toward a user. Thus, by pulling 150 down on the tether 148, a user may pull 152 the carriage 38 toward the first position and the minimum braking corresponding thereto. Conversely, by releasing the tether 148 or sufficiently lowering the downward force 150 applied to the tether 148, the carriage 38 may travel toward the second position and the maximum braking corresponding thereto.

A user may engage or manipulate a tether 148 in any suitable manner. For example, in one embodiment, a tether 148 may be connected to a handle suspended at an appropriate height for the user. Accordingly, the user may simply grab the handle and pull 150 down on the tether. Alternatively, a tether may extend to engage the foot of a user. For example, a user may position a foot within a loop connected to the tether 148. Thus, by weighting the foot (e.g., shifting some of the weight 34 of the user from the carriage to the tether 148), the tether 148 may be pulled 150 downward.

Accordingly, while a carriage 34 may be the primary suspension point for the weight 34 of the user, portions of that weight 34 may be diverted as necessary to adjust the position of the carriage 38 or to otherwise increase the safety of a trolley 10. For example, in selected embodiments, various apertures 154 may be provided in a frame 14. Such apertures 154 may support redundant user support systems taking a portion of the weight 34 of a user in normal use and a substantial portion of the weight 34 of a user in compromised use. Additionally, such apertures 154 may provide locations for supporting other loads or persons not directly responsible for the operation of the trolley 10 (e.g., a rescuee being lowered from a stalled chair lift).

In selected embodiments, a trolley 10 in accordance with the present invention may be configured for rapid engagement with and disengagement from a cable 12. In such embodiments, a capture 108 may be omitted. Alternatively, a capture 108 providing rapid release may be employed. For example, in one embodiment, a capture 108 may comprise a flexible cable. So configured, the capture 108 may extend from a first mount 156 positioned on one side of a brake assembly 20 to a second mount 158 positioned on the other side of the brake assembly 20. The engagement between the capture 108 and one mount 156 may be substantially permanent, while a release mechanism 160 (e.g., quick release hook, carabiner, or the like) may provide selective engagement between the capture 108 and the other mount 158.

In certain embodiments, a brake pad 88 may be formed as a monolithic and homogeneous unit. For example, a brake pad 88 may be formed as a single, seamless piece of a non-elastic material (e.g., UHMWPE). Alternatively, a brake pad 88 may include various other segments 89 or inserts 89 selectively providing additional control over braking characteristics. A pivot bolt 162 may pivotably secure the brake pad 88 to the frame 14. If desired or necessary, a brake assembly 20 in accordance with the present invention may include an adjustable stop 164. In some embodiments, the adjustable stop 164 may provide a selectively adjustable limit on the pivoting of the brake pad 88. In other embodiments, the adjustable stop 164 may dictate the angle at which the brake pad 88 may contact a cable 12.

Figure 15:
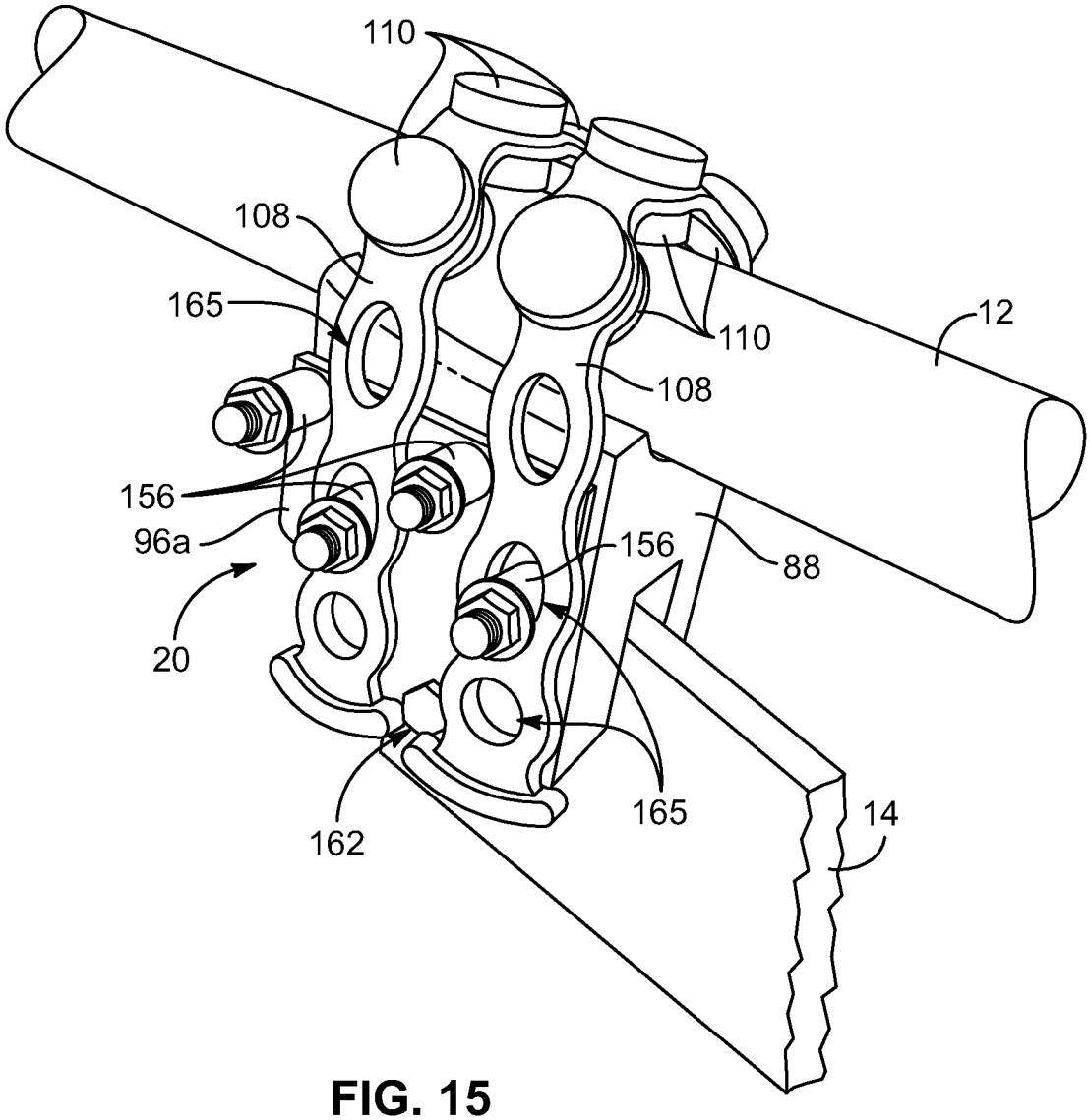
FIG. 15 is a perspective view of an alternative embodiment of a capture in accordance with the present invention.

Referring to FIG. 15, in selected embodiments, one or more captures 108 may be used to secure a brake assembly 20 to a cable 12. If desired, one or more captures 108 may be positioned to maintain a brake assembly 20 in abutment with the cable 12. For example, a capture 108 may be positioned such that the brake pad 88 and one or more slides 110 simultaneously contact a cable 12. The various slides 110 may be formed of various materials (e.g., materials such as those used in a brake pad 88) to provide a desired composite sliding or braking effect. Such an arrangement may provide additional control over the motion of the trolley 10 with respect to the cable 12.

In certain embodiments, a capture 108 may be formed of an elastic material to provide a degree of control over the normal force 128 applied thereby. In one embodiment, a capture 1087 may be formed of an elastic band material formed with various apertures 165. Mounts 158 may be configured as extensions or posts extending (e.g., in a lateral direction 11*b*) from the cheek plates 96. Accordingly, the apertures 165 in the capture 108 may be placed over the mounts 158 to secure the capture 108 to the rest of the brake assembly 20.

Additionally, by selecting which aperture 165 is applied to which mount 158, a user may control the slack between the slides 110 and the cable or, alternatively, the tension in the capture 108 pulling the slides 110 into contact with the cable 12. The normal force 128 may thus be increased sufficiently to hold the trolley 10 in place on the cable 12 both during application of the trolley 10 the cable 12 and securement of a user to the trolley 10. The effect of the capture 108 may thus bias the cable 12 against the brake pad 88, hold the trolley 10 in place, provide additional braking effect in operation, or some combination thereof. In practice, ten to twenty pounds of braking force is readily achieved by manually tensioning a pair of captures 108. On portions of a cable 12 having little declination, the captures 108 may be loosened or released to eliminate their braking effect.

Moreover, by tensioning the capture 108 sufficiently to prevent motion of the trolley 10 along the cable 12, a user may not have to contend with the trolley 10 sliding along the cable 12 as the user is attempting to properly apply weight 34 to the frame 14. This may provide more precise control of movement of the trolley 10 at all times, particularly on portions of the cable 12 at steep angles (e.g., greater than 30 degrees) or in close quarters near suspended chairs or gondolas being serviced.

Figure 16:
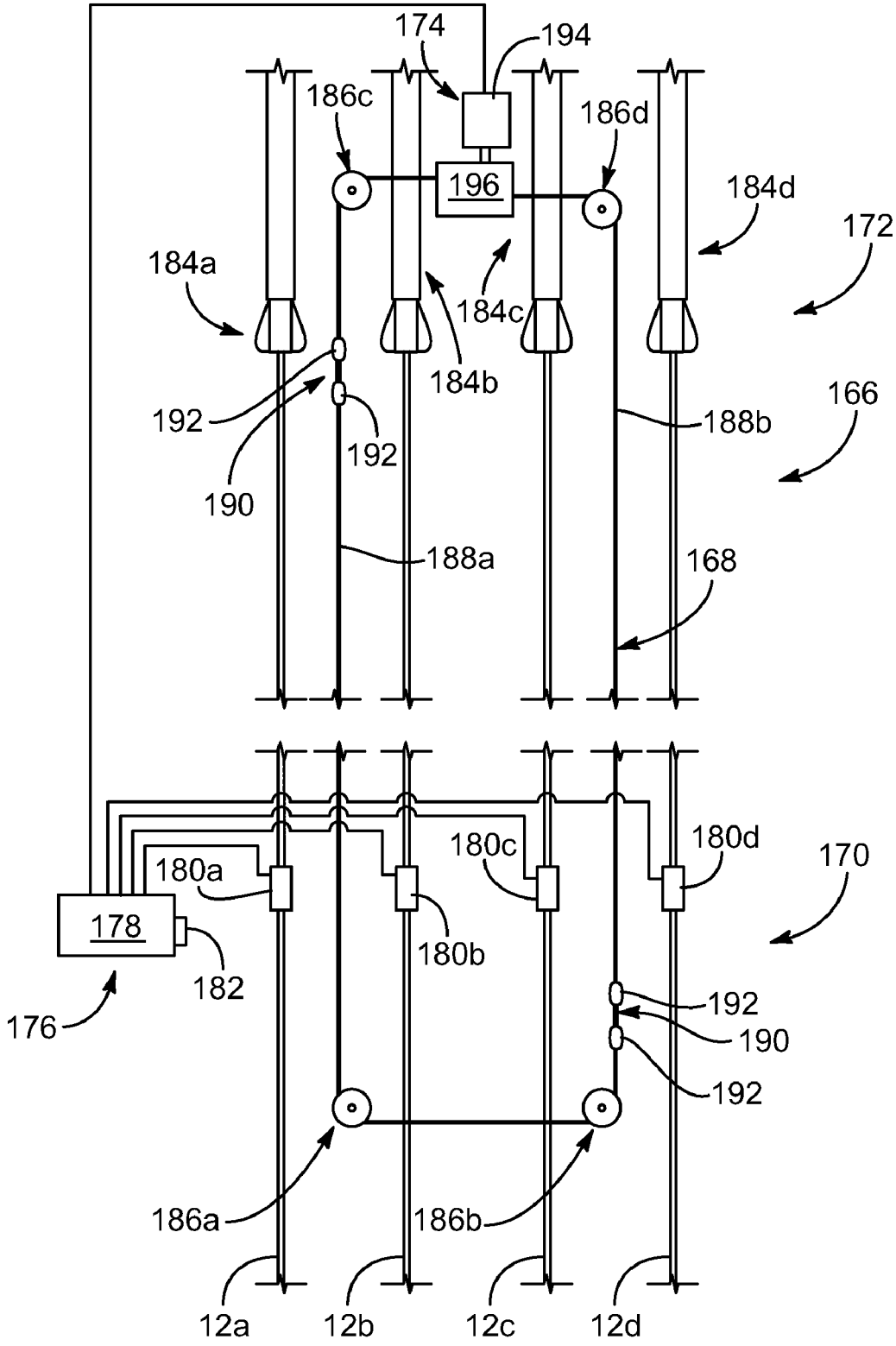
FIG. 16 is a partial, top, plan view of a trolley retrieval system in accordance with the present invention.

Referring to FIG. 16, trolleys 10 in accordance with the present invention may be used as the basis for an amusement or thrill ride. One of the potential hazards of a ride employing trolleys 10 in accordance with the present invention is the possibility of collision. For example, a first rider may ride a first trolley 10 to some location along a cable 12. Assuming that the first rider has reached the bottom and exited the ride, a second rider may ride a second trolley 10 down the same cable 12. Accordingly, if the first rider did not actually reach the bottom, serious injury may occur when the second rider collides with the first rider. While communication between finish area operators, or sensors thereat, and start area operators, or sensors thereat, may reduce the risk of such collisions, the possibility of miscommunication or malfunction permits some risk of collision to remain.

Also, for amusement rides, revenue may largely depend on the number operators employed to operate the ride and the number of users served within a given period of time. Accordingly, revenue may be increased in various ways. For example, a plurality of cables 12 may be employed. Additionally, the rate at which each cable is utilized may be increased. That is, the method for circulating trolleys 10 (i.e., transporting trolleys 10 from the finish area back to the start area) may be optimized. Also, the number of operators may be minimized.

In view of the foregoing, a trolley retrieval system 166 in accordance with the present invention may be configured to maximize user throughput, minimize operator interaction, and eliminate the risk of collision. In selected embodiments, a system 166 may include multiple (e.g., four) cables 12 held in suspension between first and second supports. A retrieval line 168 may be suspended in a closed loop extending from proximate a start area 170 to proximate a finish area 172. In general, the start area 170 may correspond to the first or upper support, while the finish area 172 may correspond to the second or lower support. A motivator 174 may selectively circulating the retrieval line 168 around the loop. A controller 176 may control operation of the motivator 174.

In selected embodiments, a controller 176 may include a processor 178 and one or more end-of-travel sensors 180 sensing when a trolley 10 nears the start area 170. The sensors 180 may be operably connected to the processor 176 to appropriately pass thereto a stop signal informing the processor 176 that one or more of trolleys 10 is sufficiently near the start area 170. The processor 176 may be programmed to issue, in response to the stop signal, a stop command causing the motivator 174 to cease circulation of the retrieval line 168. The processor 176 may be further programmed to issue, in further response to the stop signal, a reverse command causing the motivator 176 to circulate the retrieval line 168 in an opposite direction when it resumes circulation the retrieval line 168. A controller 176 may further include a retrieval switch 182 operably connected to cause, when activated, the motivator 174 to resume circulation of the retrieval line 168. The retrieval line 168 may travel down with a user or simply disconnect to be reconnected only when retrieval is needed. Thus, movement of the retrieval line 168 may be continuous in a loop of a constant sense of direction.

At the finish area 172, each cable 12 may include arresting equipment 184. Arresting equipment 167 may include whatever structures are necessary to safety slow a trolley 10 and associated user to a stop. In selected embodiments, the arresting equipment 184 may include terminal brake acceptors (e.g. receiver or actuator), springs, and weights as disclosed in U.S. Pat. No. 6,622,634.

In certain embodiments, a retrieval system 166 may include a plurality of sheaves 186 cooperating to hold the retrieval line 168 in suspension. If desired, each sheave 186*a*, 186*b*, 186*c*, and 186*d* of the plurality of sheaves 186 may be connected to one of the first and second supports. Accordingly, the retrieval line 168 may be suspended in the same catenary form or angle as that of the various cables 12. Also, the sheaves 186 may define the loop about which the retrieval line 168 may circulate or travel. In selected embodiments, different legs or portions 188 of the retrieval line 168 may serve different cables 12 during operation. For example, in a four cable embodiment, a first leg 188*a* of a retrieval line 168 may be positioned to serve two cables 12*a*, 12*b*, while a second leg 188*b* of the retrieval line 168 may be positioned to serve the other cables 12*c*, 12*d*.

In certain embodiments, a retrieval line 168 may be formed of any suitable material. In one embodiment, a retrieval line 168 may be formed of a relatively lightweight, synthetic polymer rope. If desired or necessary, a retrieval line 168 may include one or more swivels 190 relieving twisting imposed thereon or generated therein. Various interface mechanisms 192 (e.g., carabiners, loop reinforcements, or the like) may provide the interface between the line 168 and the swivels 190. In selected embodiments, the swivels 190 or interface mechanisms 192 may provide a location at which a trolley 10 may connect to or engage the retrieval line 168. Additionally, the swivels 190 and interface mechanisms 192 may provide break points supporting replacement of certain portions of the retrieval line 168 should wear so dictate.

In selected embodiments, a motivator 174 may include a motive source 194 coupled to a line engagement system 196. In certain embodiment, a motive source 194 may provide rotation to the line engagement system 196, which, in turn, may induce movement (e.g., circulation) of the retrieval line 168. In one embodiment, a motive source 194 may comprise an electric motor. In such an embodiment, the motivator 174 may further include a polarity switch switching, in response to the reverse command, the polarity of the current supplied to the electric motor. The motive source 194 may operate in a single direction such that the retrieval line 168 loops continuously. Thus, the upward leg of the retrieval line 168 corresponds to retrieval of a harness or seat unit, and the downward leg "deadheads" back to the finishing location for a new pickup. In such an arrangement, links for connecting to harnesses or seats may be removable from the line 168.

Figure 17:
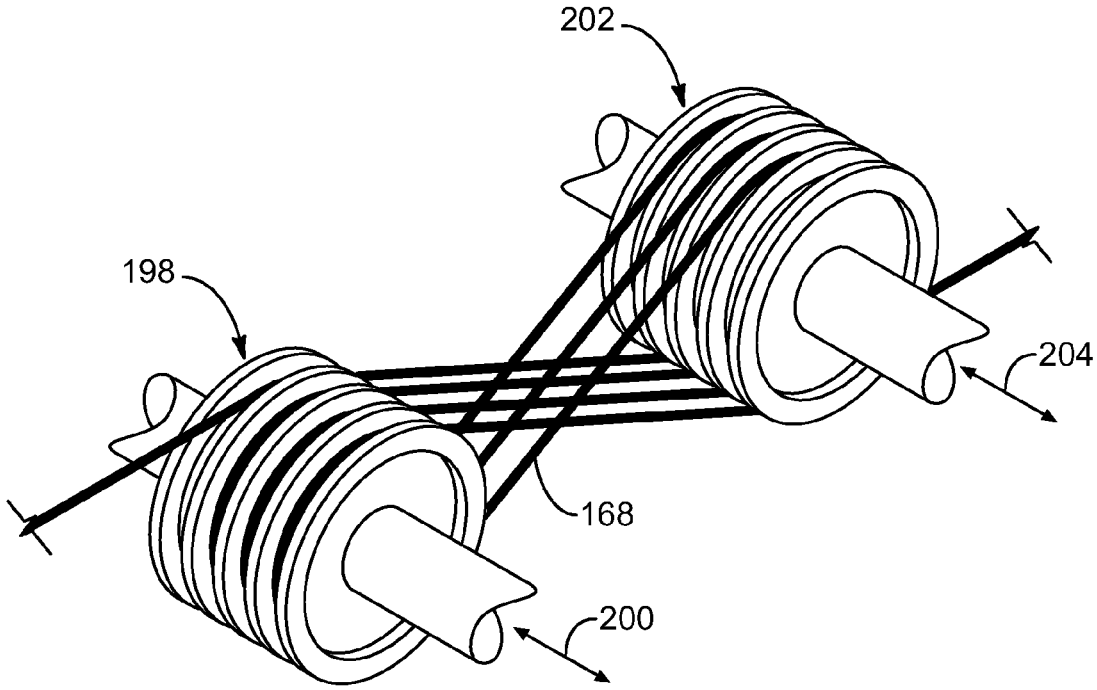
FIG. 17 is a partial, perspective view of a line engagement system from a trolley retrieval system in accordance with the present invention.

Referring to FIG. 17, a line engagement system 196 may include any structures effectively translating motion of the motive source 192 into motion of the retrieval line 168. In certain embodiments, a line engagement system 196 may include a first bank of sheaves 198 rotating about a first axis 200 and a second bank of sheaves 202 rotating about a second axis 204, spaced from and parallel to the first axis 200. The retrieval line 168 may be reeved between the first and second banks of sheaves 198, 202. The motive source 194 may provide rotation (directly or appropriately "geared") to the first bank 198, the second bank 202, or both. In such an arrangement, the surface area between the line 168 and the sheaves may be selected to be sufficient to provide adequate frictional engagement therebetween.

Figure 18:
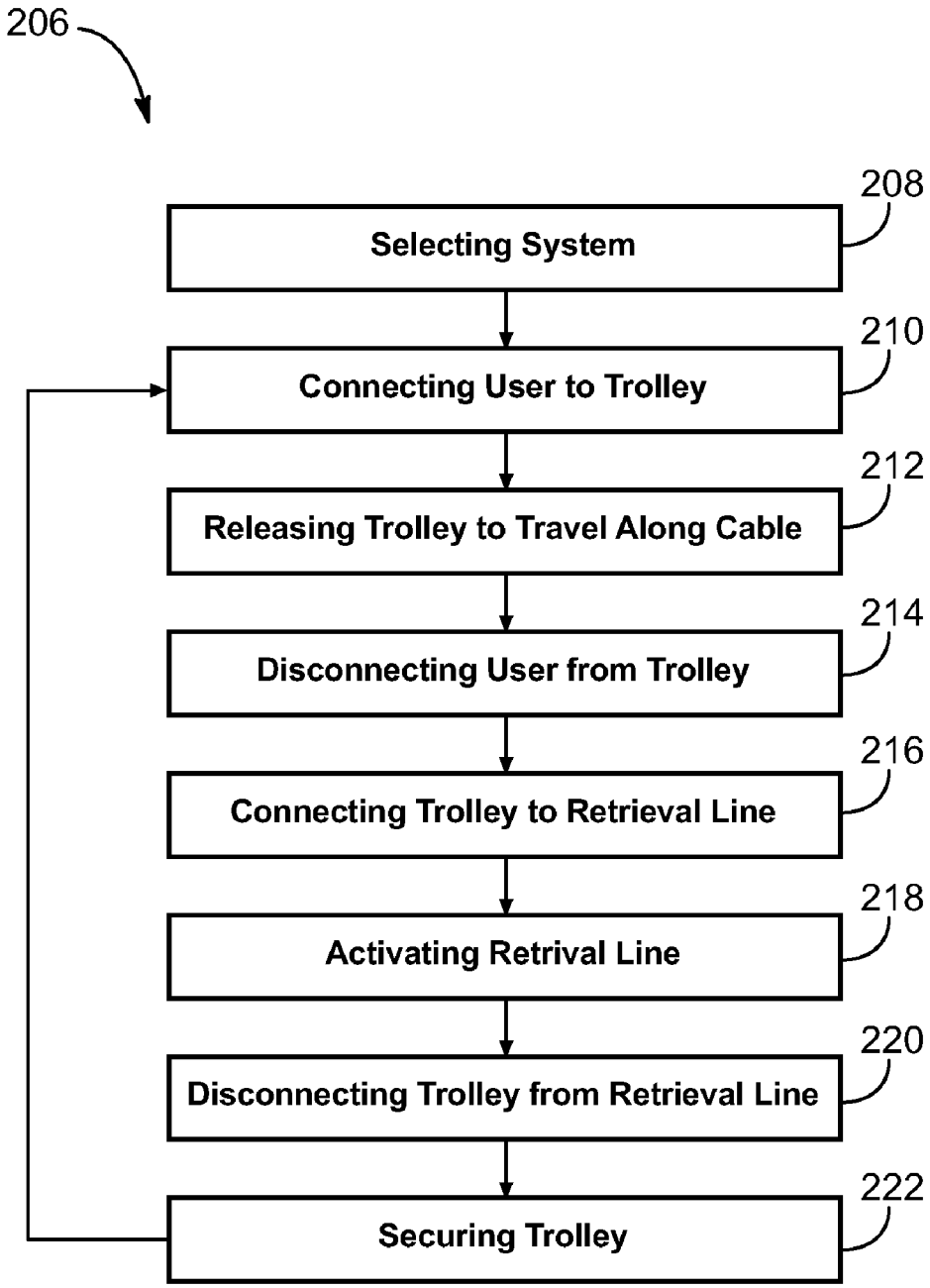
FIG. 18 is a schematic block diagram of a method for operating a trolley retrieval system in accordance with the present invention.

Referring to FIG. 18, in operation, a method 206 in accordance with the present invention may begin with the selection 208 of a system 166 comprising one or more cables 12 held in suspension between first and second supports and a trolley 10 positioned to travel along each cable 12. In selected embodiments, one trolley 10 may be assigned to each cable 12 and remain secured thereto. So configured, the possibility of collision is eliminated as only one trolley 10 is ever applied to a cable 12 in such a system. Thus, unless and until a trolley 10 is retrieved (circulated from the finish area 172 bak to the start area 170), no new riders will be sent down that cable 12.

Once an appropriate system 166 has been selected 208, a user may be connected 210 to the trolley 10. In selected embodiments, connecting 210 a user to a trolley 10 may include positioning and securing a user within a harness or seat suspended from the trolley 10. Following securement 210 of a user in the harness, the trolley 10 may be released 212 to travel along the cable from proximate the first support (i.e., the start area 170) to proximate the second support (i.e., the finish area 172). At the finish area 170, the user may be disconnected 214 from the harness. The trolley 10 and harness may then be connected 216 to a retrieval line 168 for the return trip.

A trolley 10 may be connected 216 to a retrieval line 168 by any suitable method using any suitable structures. In one embodiment, a trolley 10 may include a tether connected thereto. A first end of the tether may connect to the harness suspended from the trolley 10. A second end of the tether may include a quick-release hook (e.g., carabiner) providing rapid engagement with a swivel 190 or interface mechanism 192 of a retrieval line 168. When the first end of a tether is pulled (e.g., by the retrieval line 168), the tether may lift the harness up toward the trolley 10. Once the harness cannot be lifted further, additional pulling of the tether may induce travel of the trolley 10 along the cable 12. By cinching or lifting the harness, the tether may reduce air drag as the trolley 10 is circulated back to the start area 170. Also, lifting the harness may reduce flopping and whipping of the harness during travel. Furthermore, lifting the harness may facilitate passage of the harness over obstacles such as a starting gate positioned at the start area 170.

Once a trolley 10 connected 216 to a retrieval line 168, the motivator 174 may be activated 218 to draw the trolley 10 along the cable 12 from proximate the second support (i.e., the finish area 172) to proximate the first support (i.e., the start area 170). When one or more of the trolleys 10 connected 216 to a retrieval line 168 activates an end-of-travel sensor 180, the motivator 174 may stop the retrieval line 168. The trolley 10 or trolleys 10 may then be disconnected 220 from the retrieval line 168 and secured or prepared for future use 210.

As stated hereinabove, in selected embodiments, a processor 176 may be programmed to issue, in response to a stop signal, a reverse command causing the motivator 176 to circulate the retrieval line 168 in an opposite direction when it resumes circulation the retrieval line 168. So configured, the engagement locations (e.g., swivels 190, interface mechanisms 192) between a retrieval line 168 and a trolley 10 may be securely or even permanently attached and travel in a cycle from the starting area 170 to the finishing area 172 and back. Alternatively, interface mechanisms may be clamped and removed readily so the line 168 may travel with only a loop of one "sense" of direction only.

Moreover, while one engagement location is stopped at the starting area 170, another may be stopped at the finish area 172. Accordingly, in selected embodiments, while one or more trolleys 10 are being loaded 210 with users, other trolleys 10 may be connected to a retrieval line 168. Also, while one or more trolleys 10 are pulled from the finish area 172 to the start area 170, other engagement locations on the retrieval line 168 may be returned to the finish are 172 to continue the cyclical pattern. So configured, a trolley retrieval system 166 in accordance with the present invention may provide a substantially continuous throughput, minimize operator interaction, and eliminating the risk of collisions.

Figure 19:
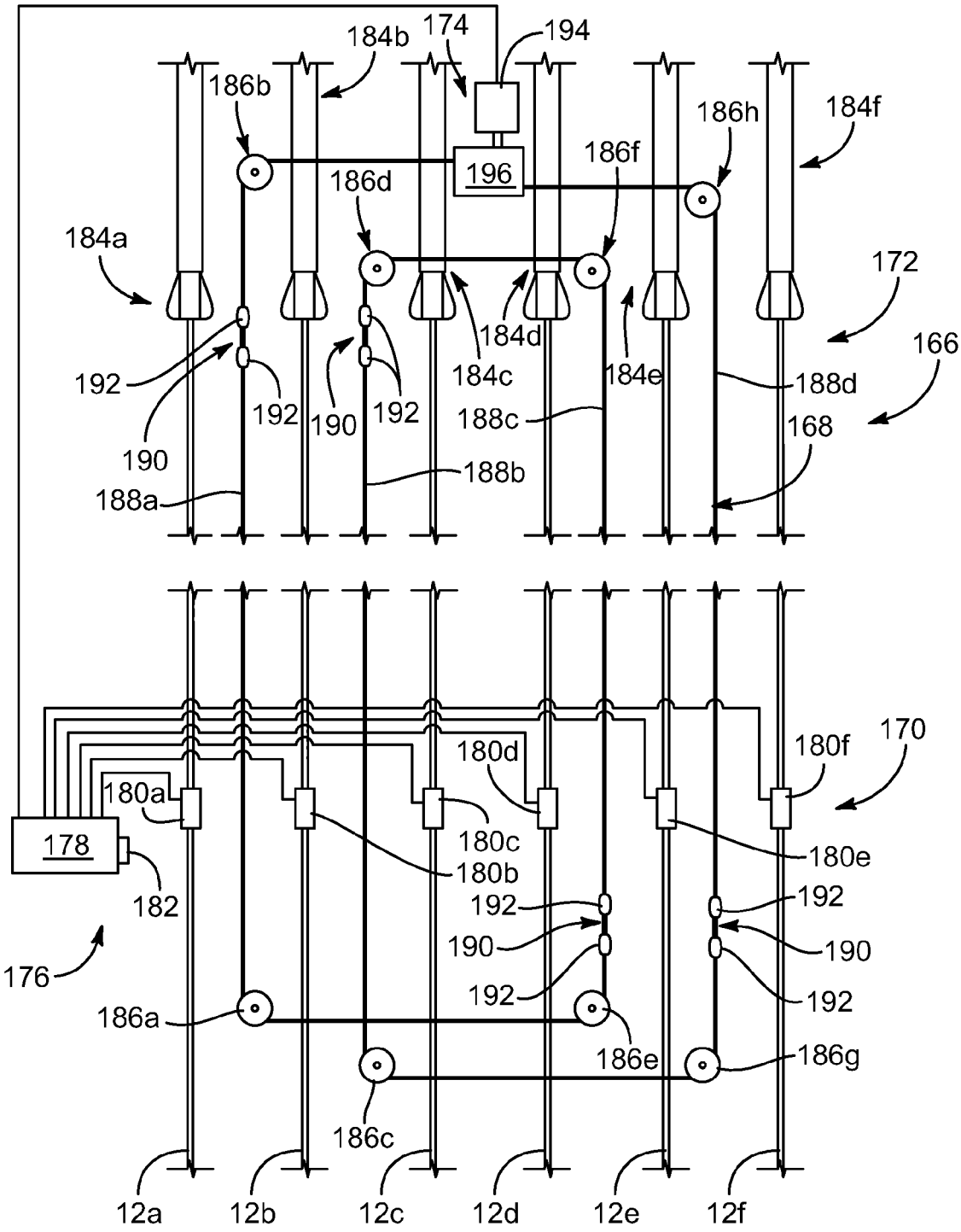
FIG. 19 is a partial, top, plan view of an alternative embodiment of a trolley retrieval system in accordance with the present invention.

Referring to FIG. 19, a retrieval system 166 in accordance with the present invention may be configured to service any number of cables 12. Scaling of such a system 116 may occur in at least one of two ways. First, multiple loops may be created in a single retrieval line 186. Accordingly, for a system 166 serving six or eight cables 12, a retrieval line 168 may include four legs 188 or portions 188. Each such leg 188 may be positioned to service at least one cable 12. For example, certain legs 188*a*, 188*d* may service two cables 12*a*, 12*b* and 12*e*, 12*f*, respectively, while other legs 188*b*, 188*c* may service one cable 12*c*, 12*d*, each, respectively. Second, a retrieval system 166 may include various subsystems, each in itself being an independent yet cooperative retrieval system 166.

Figure 20:
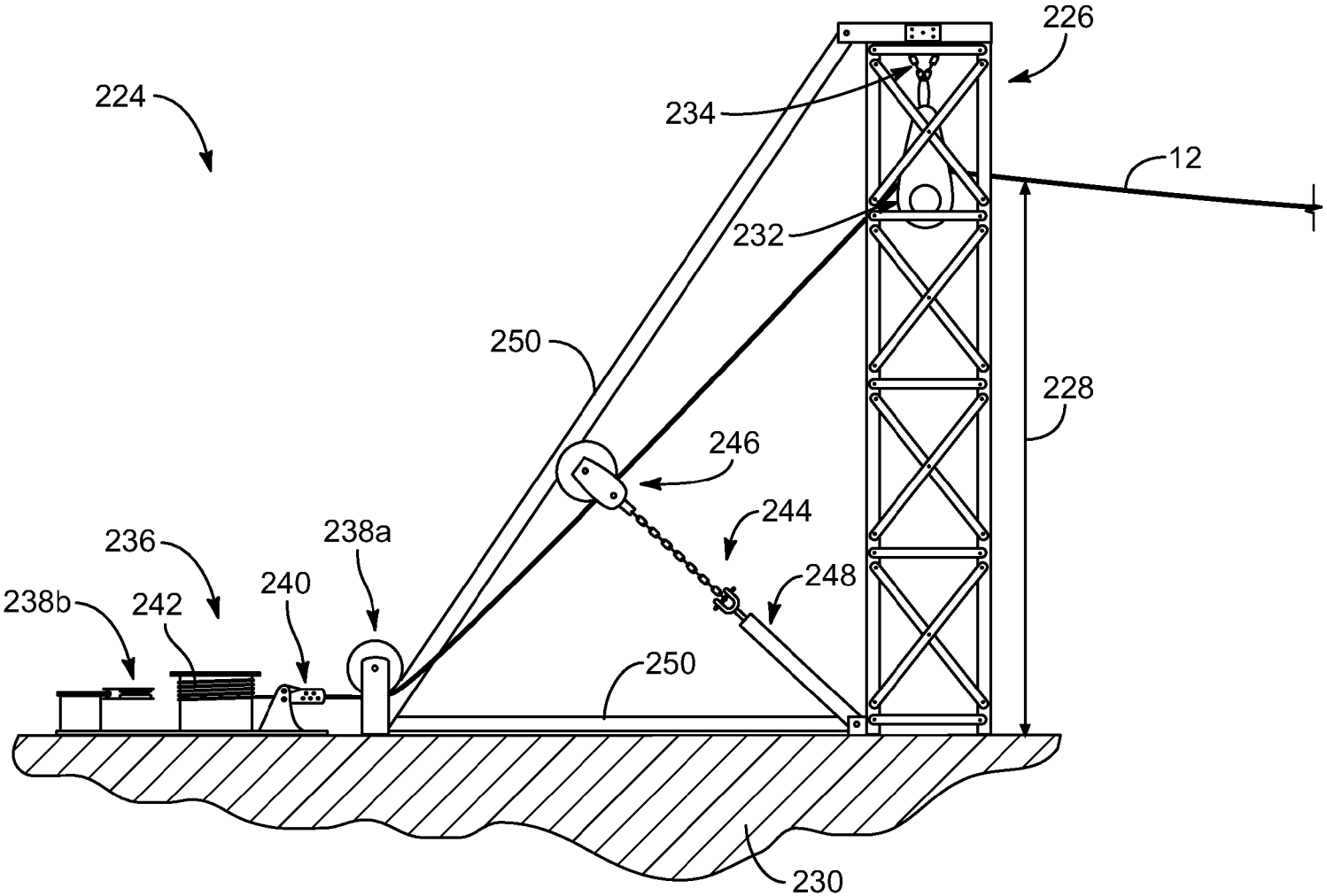
FIG. 20 is a side, elevation view of a cable support in accordance with the present invention.
Figure 21:
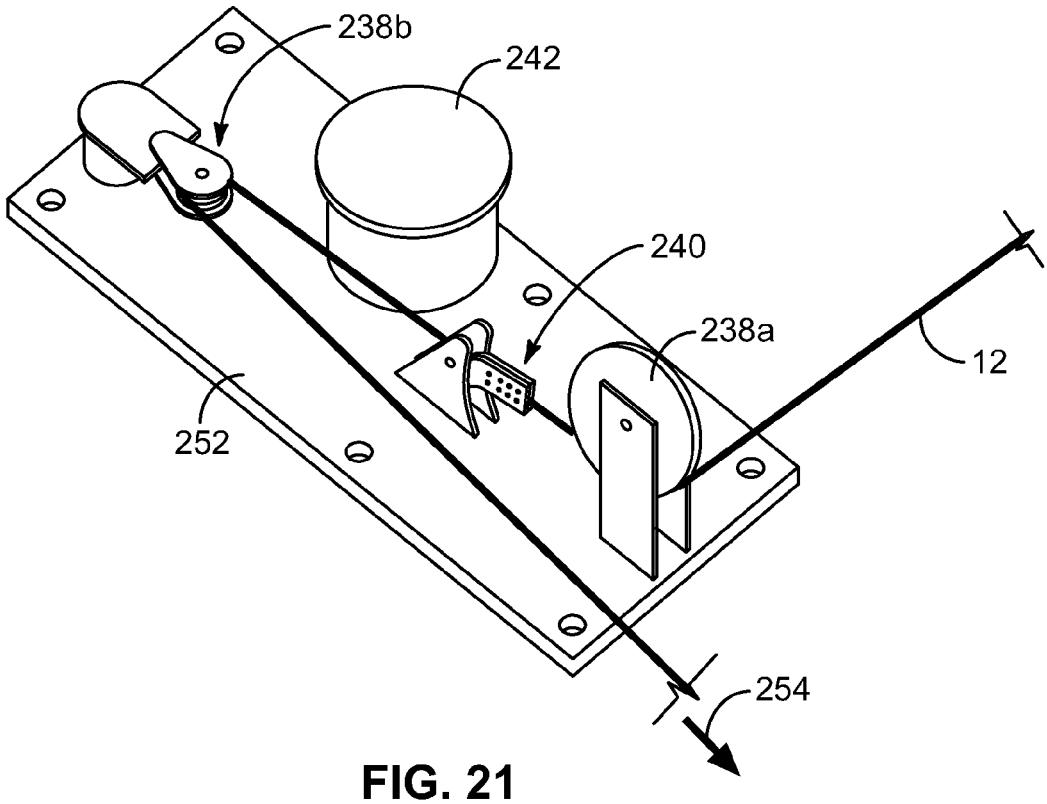
FIG. 21 is a perspective view of a cable anchoring assembly in a slack-take-up mode in accordance with the present invention.
Figure 22:
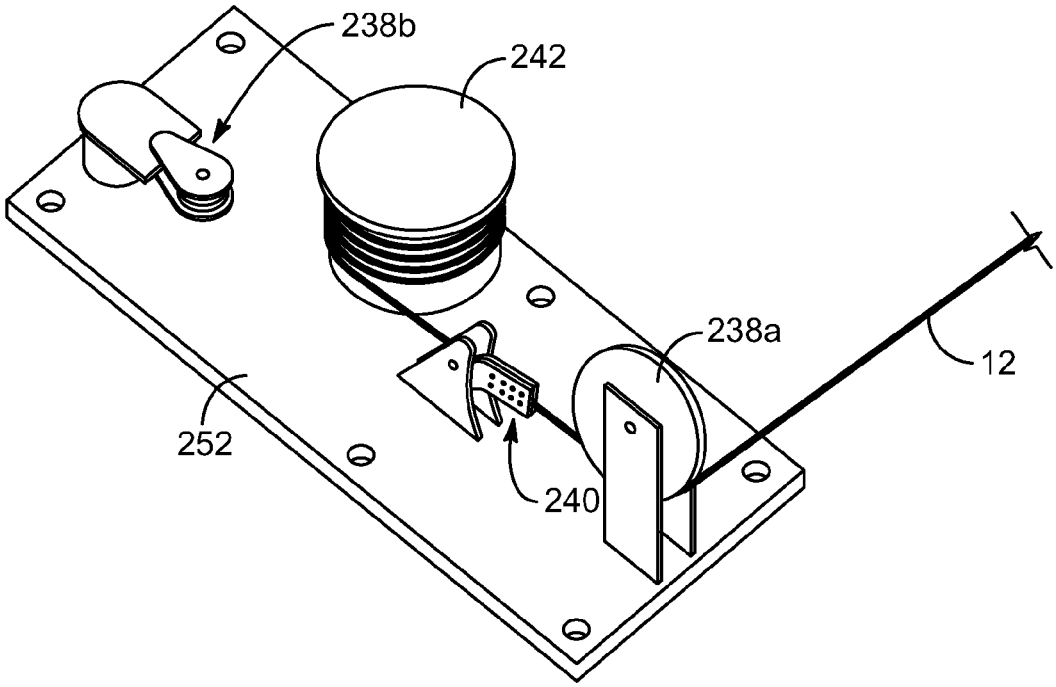
FIG. 22 is a perspective view of a cable anchoring assembly in a tied-off configuration in accordance with the present invention.

Referring to FIGS. 20-22, an upper or lower support 224 for suspending a cable 12 may be configured in any suitable manner. In selected embodiments, a support 224 may perform at least three functions, namely anchoring, positioning, and tensioning a cable 12. In one embodiment a support 224 may include a tower 226 positioning a cable 12 at a desired height 228 above the ground 230 or other supporting surface 230. A tower 226 may include a sheave 232 suspended from a sheave mount 234 to engage and support the cable 12. The height 228 of the cable 12 may be controlled by altering the height of the tower 226, by altering the length of the sheave mount 234, or by some combination thereof.

After passing over the sheave 232 of a tower 226, a cable 12 may extend to an anchor assembly 236. In selected embodiments, an anchor assembly 236 may include one or more sheaves 238 to redirect the cable 12, one or more cable clamps 240, and a wrapping post 242. In one embodiments, an anchor assembly 236 may be arranged such that a cable 12 may pass under a sheave 238*a*, through a cable clamp 240, and wrap around a wrapping post 242.

In certain embodiments, a tension assembly 244 may be positioned between a tower 226 and an anchor assembly 236. A tension assembly 244 may deflect the cable 12 to cause relatively fine adjustments to the tension or suspension shape of a cable 12. In one embodiment, a tension assembly 244 may include a sheave 246 positioned to capture the cable 12. The sheave 246 may be connected to an adjuster 248. Accordingly, changes in the length of the adjuster 248 (e.g., decreases in the length of the adjuster 248) may deflect the cable 12 from its path otherwise. The greater the deflection of the cable 12, the greater the increase in tension, the flatter the suspension shape of the cable (e.g., less sag between supports 226), or both.

In selected embodiments, changes in length of an adjuster 248 may be manually induced. Alternatively, changes in length of the adjuster 248 may be automatically calculated and applied to periodically or continuously adjust cable tension (e.g., to compensate for changes in length of the cable 12 due to changes in temperature and the like). In certain embodiments, an adjuster 248 may be a hydraulic ram.

If desired or necessary, one or more supports 250 may extend between a tower 226 and an anchor assembly 236. Such supports 250 may increase the strength and rigidity of the support 224. Additionally, such supports 250 may facilitate the transfer of loads imposed on the various structures 226, 236 to underlying foundation.

A support 224 in accordance with the present invention may be positioned at either end of the cable 12. In certain embodiments, a tension assembly 244 may be positioned at only one end of a cable 12. Alternatively, when greater adjustment capacity is desired, a tension assembly 244 may be positioned at each end of a cable 12.

During installation and initial suspension of a cable 12, significant slack of the cable 12 must be appropriately consumed before the cable 12 may be secured or "tied off." In selected embodiments, an anchor assembly 236 may support rapid consumption of slack cable 12. For example, in selected embodiments, an anchor assembly 236 may include a first sheave 238*a* receiving cable from a tower 226. The cable 12 may pass from the first sheave 238*a*, through a cable clamp 240, past a wrapping post 242, to a second sheave 238*b*. In one embodiment, the various components 238*a*, 238*b*, 240, 242 of the anchoring assembly 236 may be secured to an anchor plate 252, which, in turn, may secure to an appropriate foundation.

After passing through the second sheave 238*b*, a cable 12 may be pulled 254 in a variety of directions. If desired, the slack of a cable 12 may be pulled 254 through an anchoring assembly 236 by a tractor. Thus, the variety of directions at which the cable 12 may be pulled 254 may allow the tractor to selected the best route for accomplishing the task.

Moreover, once a cable 12 achieves a desired suspension shape, pulling 254 of the cable may cease and the cable clamp 240 may be tightened. Once the clamp 240 is secured, the cable 12 may be appropriately cut and wrapped around the wrapping post 242. Once the cable 12 is tied off, the clamp 240 released. The cable 12 will remain in the desired configuration, as transitioning from clamp 240 to wrapping post 242 requires no guess work or estimates as to how the shape of the cable 12 will change once the temporary securement is released.

In selected embodiments, a tractor or the like may not provide sufficiently fine adjustment of the suspension position of a cable 12. In such embodiments, a tractor or the like may draw or "consume" the bulk of the slack, while leaving the fine tuning of the suspension to an adjuster 248. That is, before an adjuster 248 is fully incorporated into a tension assembly 244, the adjuster 248 may be fitted with a clamp to engage a cable 12. The adjuster 248 may then incrementally, and with significant precision, pull 254 the cable 12 to a desired suspension shape. Alternating engagement between the cable clamp 240 of the anchor assembly 236 and the clamp associated with the adjuster 248, the adjuster 248 may take multiple "bites" or pulls at the cable 12. Again, once the cable 12 is properly positioned, pulling 254 of the cable may cease. The cable clamp 240 may be tightened and the cable 12 may be appropriately cut and wrapped around the wrapping post 242.

In selected embodiments, once installation of a cable 12 is complete, the second sheave 238*b* and cable clamp 240 may be removed (e.g., unbolted). If desired, the components 238*b*, 240 may be re-used on other anchoring assemblies 236 to facilitate installation and initial suspension of other cables 12.

Figure 23:
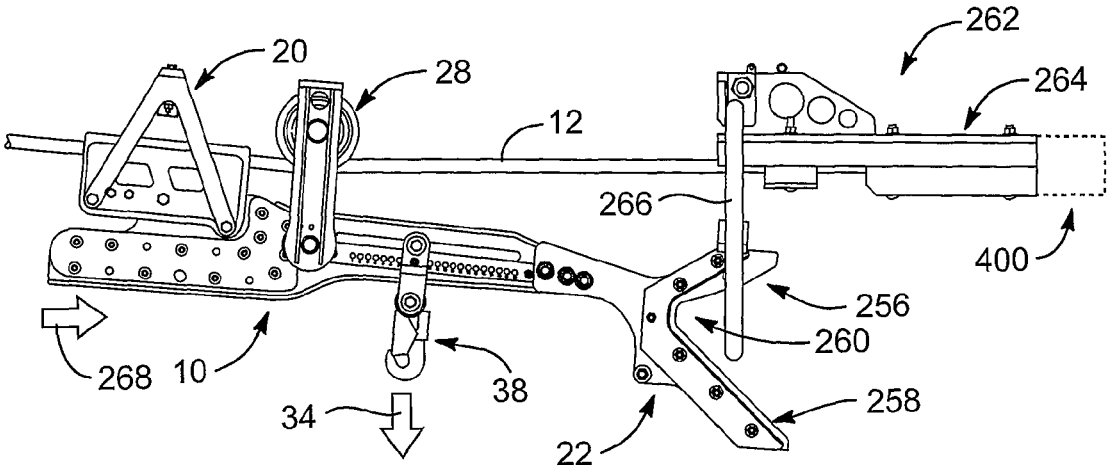
FIG. 23 is a side elevation view of a trolley traveling toward an engagement mechanism in accordance with the present invention.
Figure 24:
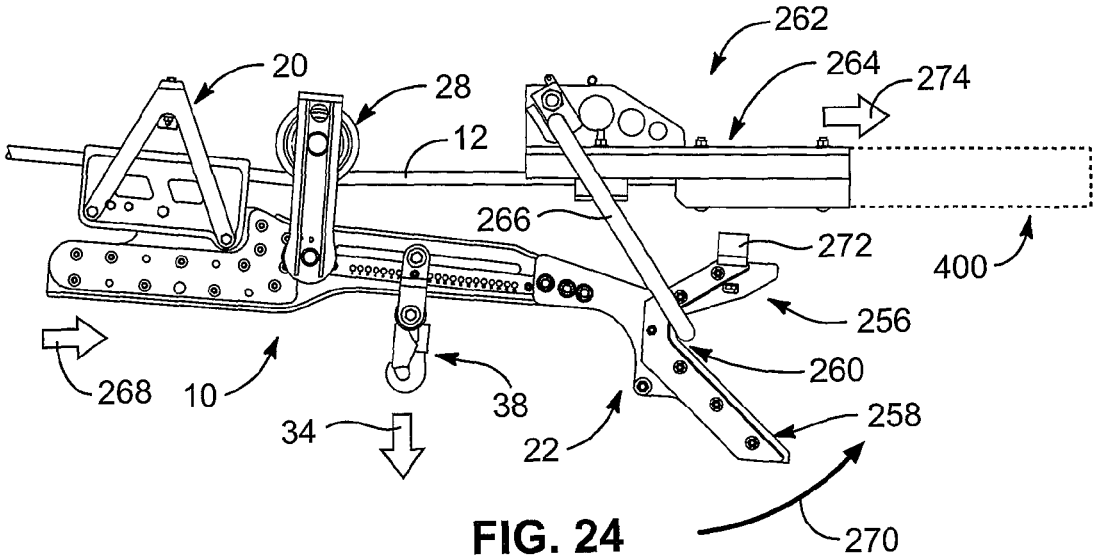
FIG. 24 is a side elevation view of a trolley having a guide engaging a capture element pivotably suspended from a carriage of an engagement mechanism in accordance with the present invention.
Figure 25:
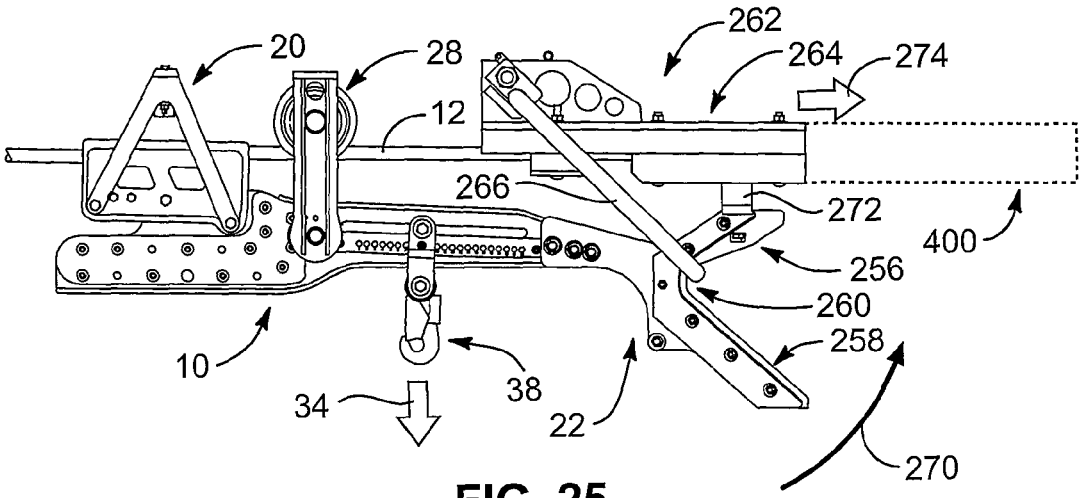
FIG. 25 is a side elevation view of a trolley and engagement mechanism fully engaged with one another, the capture element having lifted the trolley in accordance with the present invention.

Referring to FIGS. 23-25, in selected embodiments, a bumper assembly 22 in accordance with the present invention may be configured as a guide 22. For example, a bumper assembly 22 may be formed as a guide 22 or yoke 22 having two extensions 256, 258 angling away from one another to form a central vertex 260 therebetween. A guide 22 may facilitate engagement with an engagement mechanism 262.

In selected embodiments, an engagement mechanism 262 may be configured to slide along a cable 12. An engagement mechanism 262 may provide the interface between a trolley 10 and a deflecting element. Momentum may be transferred from a moving trolley 10, through an engagement mechanism 262, and into a deflecting element, where it may be cushioned, absorbed, dispersed, or otherwise managed. Accordingly, the deflecting element may gradually bring a trolley 10 to a stop.

In certain embodiments, a deflecting element may comprise the terminal brake 50 disclosed in U.S. Pat. No. 6,622,634 incorporated herein by reference. In other embodiments, a deflecting element may comprise the terminal brake (item 50) disclosed in U.S. Pat. No. 6,622,634, less the weights (item 60 therein). In still other embodiments, a deflecting element may comprise the terminal brake disclosed in U.S. Pat. No. 6,622,634, with the weights 60 replaced by light weight interfaces aligning the various springs 58 with respect to one another and the cable 14.

In certain embodiments, an engagement mechanism 262 may include a carriage 264 and a capture element 266. In one embodiment, a capture element 266 may be formed as a ring pivotably suspended from a carriage 264. A capture element 266 may be positioned to capture or engage the guide 22 of an approaching trolley 10. In selected embodiments, the extensions 256, 258 of a guide 22 may direct the capture element 266 toward the vertex 260 thereof. Additional movement 268 of a trolley 10 toward an engagement mechanism 262 may result in the capture element 266 pivoting with respect to the carriage 264.

In selected embodiments, a capture element 266 may pivot with respect to a carriage 264 about a single point. Accordingly, a capture element 266 may pivot in an arc. Due the engagement between a guide 22 and a capture element 266, this pivoting may result in a lifting 270 of one end 16 of a trolley 10. This lifting 270 may continue until a guide 22 or a portion thereof contacts the engagement mechanism 262.

One effect of this lifting 270 may be a reduction in the normal force between a brake assembly 20 and a cable 14, resulting in a reduction in the braking force produced by the brake assembly 20. That is, the lifting 270 may pivot a frame 14 of a trolley 10 in a direction opposite to the direction 36 urged by the weight 34 of a user.

In certain embodiments, a guide 22 may include a top bumper 272 extending upward therefrom. A top bumper 272 may be positioned to contact an underside of an engagement mechanism 262. Such contact may define an upper limit for the lifting 270. Upon reaching this upper limit, no further pivoting is possible and momentum associated with a trolley 10 may be directed through the engagement mechanism 262 and into a deflecting element in accordance with the present invention. Accordingly, a trolley 10 and engagement mechanism 262 may travel 274 together down the cable 12 against a resisting force (e.g., a gradually increasing resistance force, such as that of a spring 400 produced by a deflection element.

Because the mass of a capture element 266 may be small, only a relatively small impulse will be produced by a trolley 10 impacting thereagainst. Additionally, because the capture element 266 may pivot with respect to the carriage 264, the mass of the carriage 264 may not factor significantly into the initial impulse. Accordingly, initially substantially no momentum may be resolved by the deflecting element. However, as the capture element 266 pivots toward its upper limit, gradually more and more of the momentum of the trolley 10 and rider may be communicated through the capture element 266 to the carriage 264. Upon reaching the upper limit, the remaining momentum associated with a trolley 10 may be directed through the engagement mechanism 262 and into a deflecting element. Because an impulse is equal to force (mass multiplied by acceleration) multiplied by the time interval over which the force acts, this significant decrease in acceleration reduces the forces generated by the mass being stopped.

Figure 26:
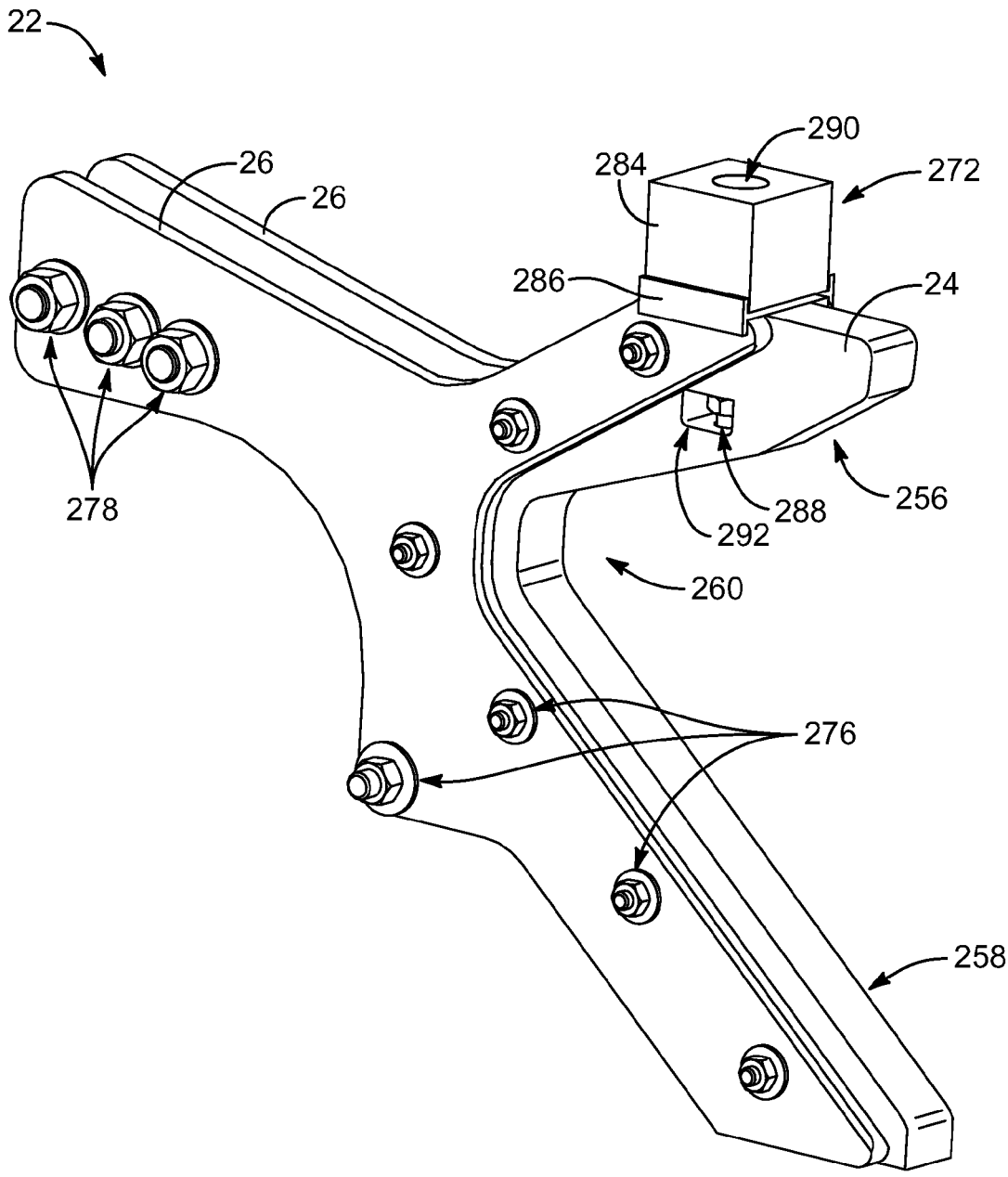
FIG. 26 is a front quarter, perspective view of one embodiment of a guide in accordance with the present invention.
Figure 27:
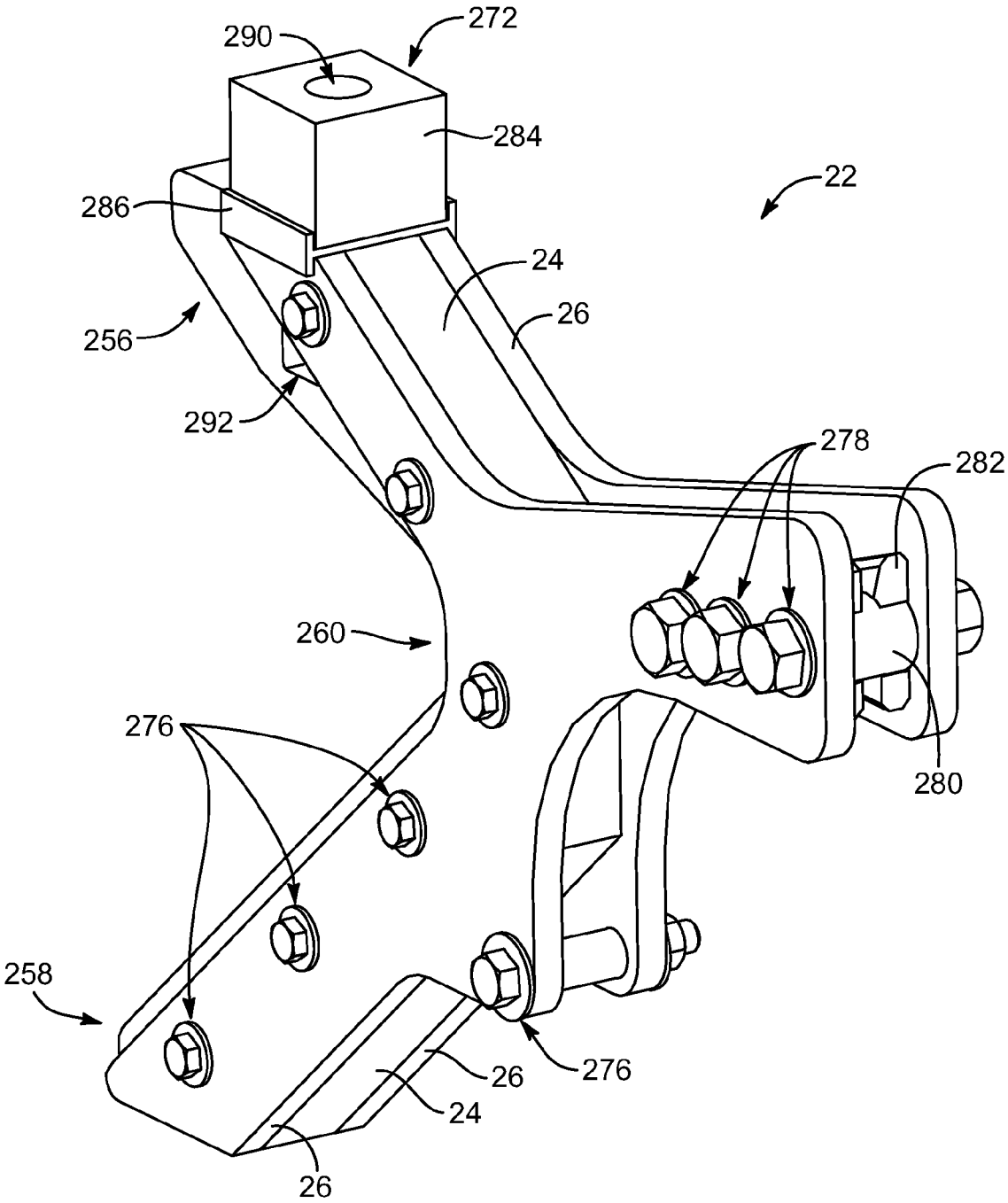
FIG. 27 is a rear quarter, perspective view of the guide of FIG. 26.

Referring to FIGS. 26 and 27, in selected embodiments, a guide 22 may be formed with two cheek plates 26 securing and stabilizing a bumper 24 held therebetween. The bumper 24 may extend beyond the cheek plates 26 such that the bumper 24 contacts a capture element 266 while the cheek plates 26 do not. Selected fasteners 276 may secure the bumper 24 and cheek plates 26 together. Other fasteners 278, spacers 280, shims 282, and the like may support securement of a guide 22 to the frame 14 of a trolley 10.

In certain embodiments, a bumper 24 may extend upward to form the top bumper 272. Alternatively, as shown in the illustrated embodiment, a top bumper 272 may be formed as a separate unit. For example, a top bumper 272 may include a bumper material 284 (e.g., HDPE, UHMWPE, PTFE, rubber compound, or the like) and a bumper mount 286 secured to a guide 22 by a fastener 288. In selected embodiments, apertures 290, 292 may formed in the bumper material 284, bumper mount 286, and guide 22 as necessary to effect securement of the top bumper 272 in place.

Figure 28:
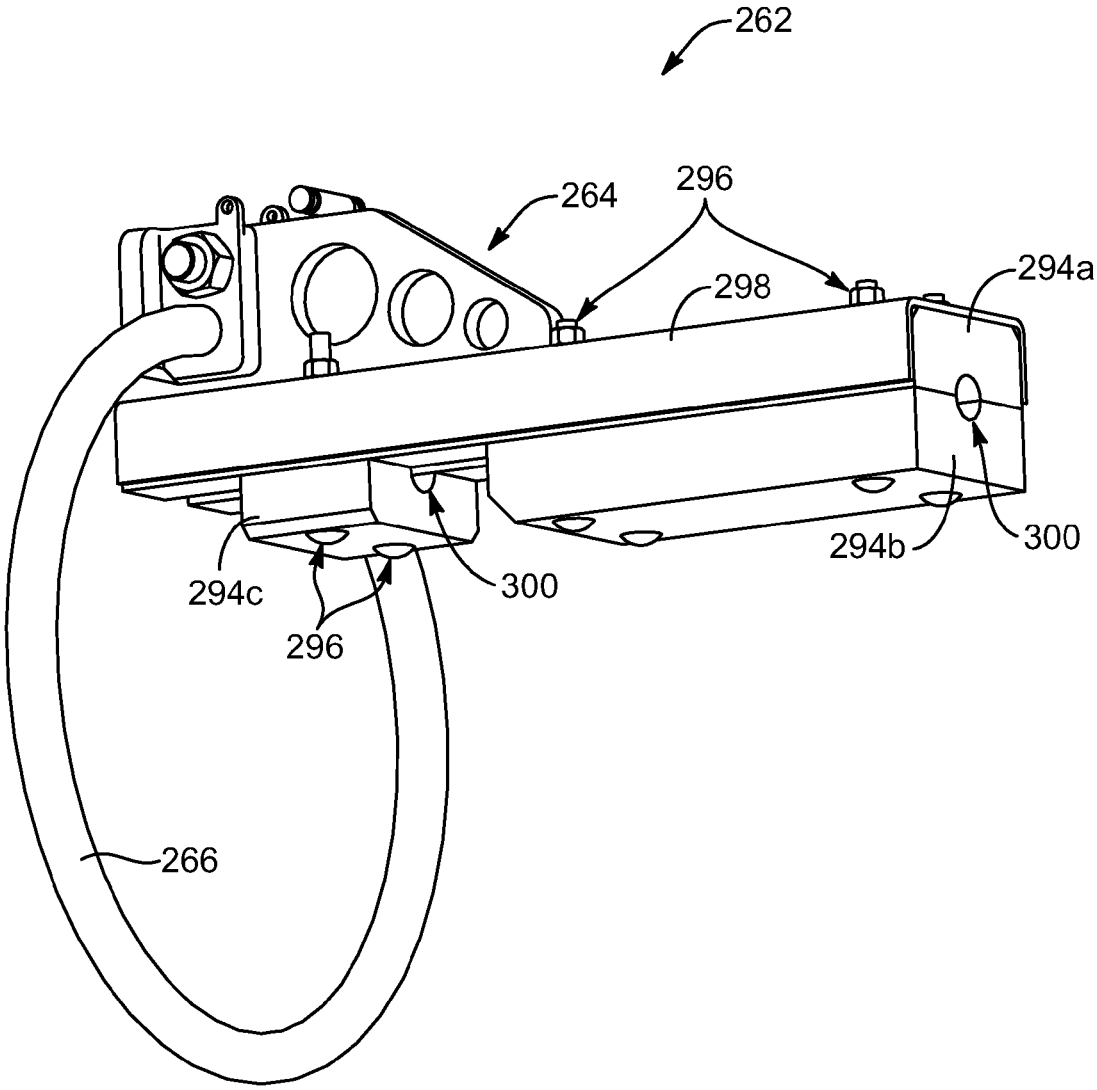
FIG. 28 is a lower rear quarter perspective view of one embodiment of an engagement mechanism facing a trolley in accordance with the present invention.
Figure 29:
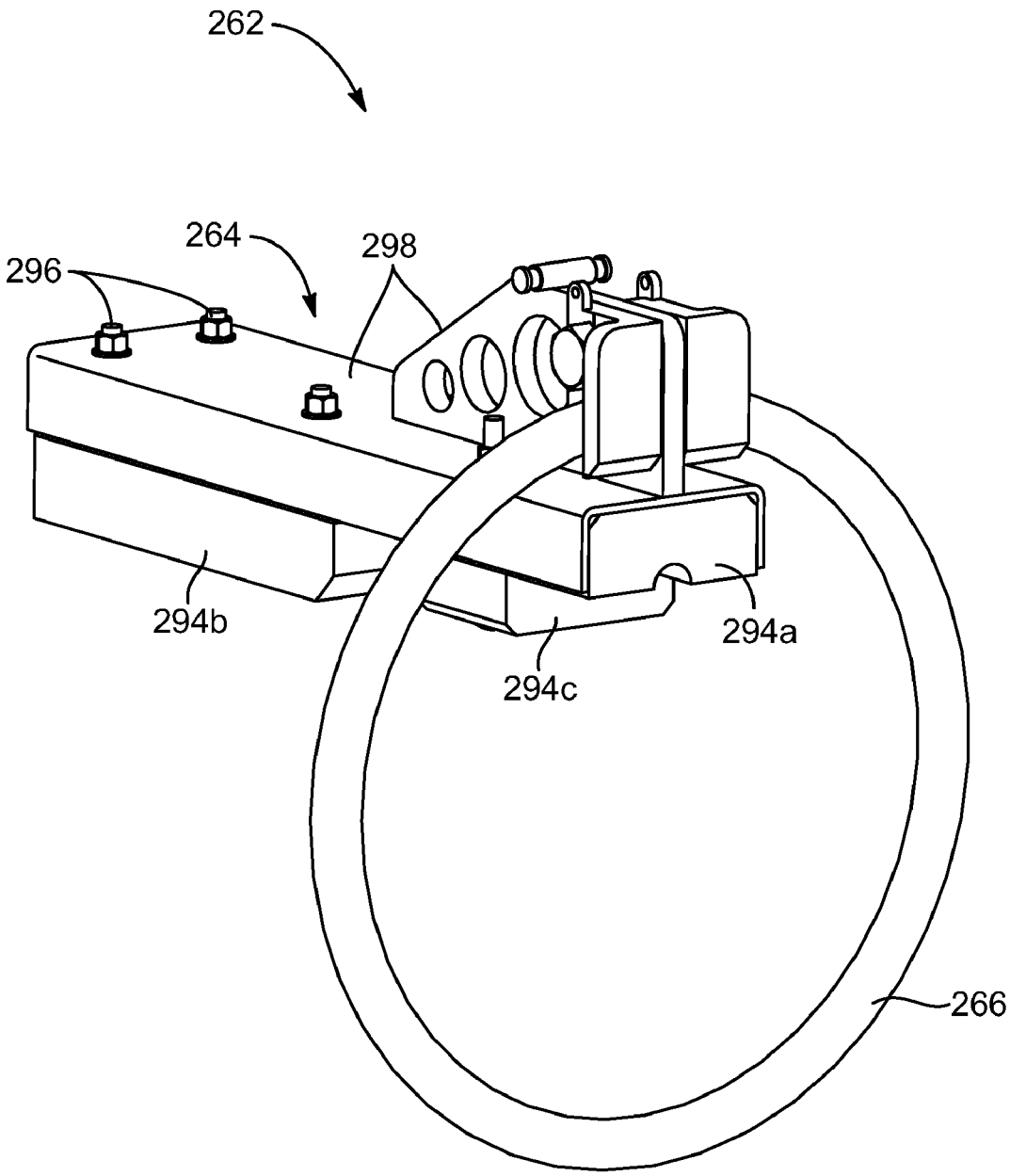
FIG. 29 is an upper, front quarter, perspective of the engagement mechanism of FIG. 28 as approached by the trolley.

Referring to FIGS. 28 and 29, in selected embodiments, a carriage 264 in accordance with the present invention may include one or more cable interfaces 294 secured by fasteners 296 to a frame 298. Cable interfaces 294 may be formed of friction reducing or friction resistant materials (e.g., HDPE, UHMWPE, PTFE, or the like). In one embodiment, a carriage 264 may include three cable interfaces 294, namely an upper cable interface 294*a*, a first lower cable interface 294*b*, and a second lower cable interface 294*c*. In certain embodiments, apertures 300 may be formed at the seams between selected cable interfaces 294 to permit a cable 12 to pass through a carriage. By positioning the apertures 300 at the seams, a carriage 264 may be installed after a cable 12 is already in place.

The frame 298 of a carriage 264 may include a mount 302 providing a location for a capture element 266 to secure to the frame 298. In selected embodiments, a fastener 304 may pivotably connect a capture element 266 to a mount 302. A capture element 266 in accordance with the present invention may have any suitable shape or configuration. In selected embodiments, a capture element 266 may be formed as a ring.

An engagement mechanism 262 in accordance with the present invention may be formed of any suitable materials. Materials may be selected to provide desirable strength, wear resistance, and the like. In selected embodiments, the materials and the shapes of an engagement mechanism 262 may be selected to reduce or minimize the mass thereof. By reducing the mass, the forces required to accelerate the engagement mechanism may be reduced. Accordingly, the process of arresting a trolley 10 in accordance with the present invention may be rendered smoother and more gradual.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method to minimize impulse loads of arrest in a trolley, the method comprising:

providing a trolley traveling along a cable suspended from supports proximate first and second ends of the cable;

initiating, proximate the first end of the cable, relative motion of the trolley with respect to the cable in response to a gravitational force;

applying a braking force to the cable, by a braking device on the trolley, between the trolley and the cable to control the speed of the trolley along the cable;

approaching, by the trolley, the second end of the cable;

relieving, by using an engagement mechanism attached proximate the second end of the cable, the braking force applied to the cable during a continuation of the motion of the trolley with respect to the cable and into the engagement mechanism; and transferring a first portion of kinetic energy corresponding to the trolley through the engagement mechanism and into a deflecting element deflecting along a direction of the cable.

2. The method of claim 1, wherein the trolley further comprises a frame, a sheave mount pivotably connected to the frame, and a sheave, rotatably mounted to the sheave mount to roll along the cable, the sheave and sheave mount suspending the frame below the cable.

3. The method of claim 2, wherein applying the braking force comprises pivoting the frame with respect to the cable in a first direction.

4. The method of claim 3, wherein relieving the braking force comprises pivoting the frame in a second direction, opposite the first direction.

5. The method of claim 4, further comprising transferring a second portion of the kinetic energy corresponding to the trolley into lifting the frame and a load suspended therefrom.

6. The method of claim 5, wherein the deflecting element comprises at least one spring and the engagement mechanism interfacing between the frame and the at least one spring.

7. The method of claim 6, wherein the engagement mechanism comprises a capture element pivotably suspended therefrom.

8. The method of claim 7, wherein the frame comprises a guide portion extending away from a remaining portion of the frame and guiding the frame into an engagement with the capture element.

9. The method of claim 8, wherein relieving further comprises lifting of the guide portion by the capture element along a path reflecting pivoting of the capture element.

10. The method of claim 9, wherein the guide portion further comprises a yoke having a vertex and extensions forming an opening therebetween, the opening receiving the capture element and the extensions guiding the capture element toward the vertex.

11. The method of claim 1, wherein applying the braking force comprises pivoting the frame with respect to the cable in a first direction.

12. The method of claim 11, wherein relieving the braking force comprises pivoting the frame in a second direction, opposite the first direction.

13. The method of claim 1, further comprising transferring a second portion of the kinetic energy corresponding to the trolley into lifting the frame and a load suspended therefrom.

14. The method of claim 1, wherein the deflecting element comprises at least one spring and the engagement mechanism interfacing between the frame and the at least one spring.

15. The method of claim 14, wherein the engagement mechanism comprises a capture element pivotably suspended therefrom.

16. The method of claim 15, wherein the frame comprises a guide portion extending away from a remaining portion of the frame and guiding the frame into an engagement with the capture element.

17. The method of claim 15, wherein relieving further comprises lifting of the guide portion by the capture element along a path reflecting pivoting of the capture element.

18. The method of claim 15, wherein the guide portion further comprises a yoke having a vertex and extensions forming an opening therebetween, the opening receiving the capture element and the extensions guiding the capture element toward the vertex.

19. A method comprising:

providing a trolley traveling along a cable suspended from supports proximate first and second ends of the cable;

initiating, proximate the first end of the cable, relative motion of the trolley with respect to the cable in response to a gravitational force;

applying a braking force to the cable, by a braking device on the trolley, between the trolley and the cable to control the speed of the trolley along the cable;

approaching, by the trolley, the second end of the cable;

relieving, by using an engagement mechanism attached proximate the second end of the cable, the braking force applied to the cable during a continuation of the motion of the trolley with respect to the cable and into the engagement mechanism;

transferring a portion of kinetic energy corresponding to the trolley through the engagement mechanism and into a deflecting element deflecting along a direction of the cable; and resolving, by the deflecting element, momentum received from the trolley, in a continuously variable direction, through the engagement mechanism, beginning at a first direction transferring substantially no momentum along the cable and ending at a second direction transferring substantially all momentum along the direction of the cable.

20. A method to decelerate a trolley, the method comprising:

controlling speed of a trolley descending on a cable by applying a braking force to the cable by a braking device on the trolley;

arresting the trolley by capturing a guide portion of the trolley by a capture element pivotably suspended from the cable, relieving the braking force by using an engagement mechanism that includes the capture element in lifting the guide portion to reduce the braking force corresponding to a pivoting motion of the capture element, and converting a portion of kinetic energy corresponding to the trolley into deflection of a spring located behind the engagement mechanism.

* * * * *